US008740336B2

(12) United States Patent
Fujimoto et al.

(10) Patent No.: US 8,740,336 B2
(45) Date of Patent: Jun. 3, 2014

(54) INK JET PRINTING APPARATUS AND INK JET PRINTING METHOD

(75) Inventors: Yasunori Fujimoto, Inagi (JP); Masato Kawakami, Misato (JP); Takeshi Honma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 13/183,604

(22) Filed: Jul. 15, 2011

(65) Prior Publication Data

US 2012/0019583 A1 Jan. 26, 2012

(30) Foreign Application Priority Data

Jul. 21, 2010 (JP) ..... 2010-163890

(51) Int. Cl.
*B41J 2/205* (2006.01)
*B41J 29/38* (2006.01)
*B41J 2/21* (2006.01)

(52) U.S. Cl.
USPC ..... 347/15; 347/9; 347/43

(58) Field of Classification Search
None
See application file for complete search history.

(56) References Cited

U.S. PATENT DOCUMENTS

| | | | | |
|---|---|---|---|---|
| 5,568,169 | A | 10/1996 | Dudek et al. | |
| 6,062,674 | A | 5/2000 | Inui et al. | |
| 6,089,697 | A | 7/2000 | Tajika et al. | |
| 6,540,329 | B1 * | 4/2003 | Kaneko et al. | 347/43 |
| 6,755,508 | B2 * | 6/2004 | Doi | 347/43 |
| 6,805,422 | B2 | 10/2004 | Takahashi et al. | |
| 7,059,713 | B2 | 6/2006 | Matsumoto et al. | |
| 7,988,277 | B2 | 8/2011 | Moribe et al. | |
| 2008/0216684 | A1 | 9/2008 | Horai et al. | |
| 2010/0165390 | A1 | 7/2010 | Nakamura et al. | |

FOREIGN PATENT DOCUMENTS

| | | | |
|---|---|---|---|
| CN | 101302369 | A | 11/2008 |
| EP | 832751 | A2 | 4/1998 |
| JP | 7-149036 | A | 6/1995 |
| JP | 8-281975 | A | 10/1996 |
| JP | 8-295034 | A | 11/1996 |
| JP | 2002-011862 | A | 1/2002 |
| JP | 2002-113850 | * | 4/2002 |
| JP | 2002-113850 | A | 4/2002 |
| JP | 2004-291627 | A | 10/2004 |
| JP | 2009-234273 | A | 10/2009 |

OTHER PUBLICATIONS

Office Action Russian Patent Application No. 2011130377, Russian Patent Offie, mailed Oct. 19, 2012.

(Continued)

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

An ink jet printing apparatus and an ink jet printing method, whereby high-permeation ink and low-permeation ink are employed to prevent a reduction in optical density is provided. The ink jet printing apparatus controls ejection of ink from print heads, so that only low-permeation ink is ejected onto the edge area of a print medium that is adjacent to a non-printing area, and this time, high-permeation ink is not employed. Further, the ink jet printing apparatus controls ejection of ink from the print heads, so that both low-permeation ink and high-permeation ink are employed for the non-edge area that is adjacent to the edge area, and to perform printing, the low-permeation ink is ejected onto the non-edge area prior to the high-permeation ink.

14 Claims, 18 Drawing Sheets

(56) References Cited

OTHER PUBLICATIONS

Communication—European Patent Office Application No. 11005960.7-1251, dated Oct. 13, 2011.

Office Action mailed Sep. 16, 2013, in Chinese Patent Application No. 201110199734.3, Chinese Patent Office.

Japanese Office Action mailed Feb. 18, 2014, in Japanese Patent Application No. 2010-163890.

* cited by examiner 2103
201
202
203
2003
x
-x
y
DIRECTION IN WHICH PRINT MEDIUM IS CONVEYED

| FIG.7A | |
|---|---|
| | FIG.7B |

2103

201

202

203

2003 x
-x
y

2103

201

202

203
y
x
-x

2003 x
-x x
-x

| FIG.12A | |
|---|---|
| FIG.12B | |

y
x
-x
x
-x
x
-x

5103

301a

302a

301b

302b

5003 y

2103

201

202

203

2003

INK JET PRINTING APPARATUS AND INK JET PRINTING METHOD

BACKGROUND OF THE INVENTION

1. Field of the Invention

The present invention relates to an ink jet printing apparatus and an inkjet printing method employed for printing images by ejecting ink onto a print medium.

2. Description of the Related Art

At present, printing apparatuses that eject ink droplets from a print head to perform printing has been widely employed as output apparatuses. In a printing apparatus that employs this system, there is a printing apparatus that ejects ink droplets from ejection ports that are formed in a print head, and forms dots on a print medium to print an image. For substantially filling a specific predetermined area of a print medium with a single color, ink dots are formed in that area by ejecting ink droplets at a high dot print density. However, in a case wherein too many ink droplets are ejected into the print area of predetermined size, ink bleeding occurs both inside and outside the print area, so that a clean outline of a printed image can not be obtained.

To resolve this problem, in Japanese Patent Laid-Open No. 2002-113850 an ink jet printing apparatus is disclosed for which a print area is divided into an outer area and an inner area, and the ink employed for printing each of the printing areas differs, depending on which area is to be printed. According to the printing apparatus disclosed in Japanese Patent Laid-Open No. 2002-113850, for the outer area, ink having a relatively low permeation rate (ink that relatively slowly permeates a print medium; hereinafter referred to as low-permeation ink) is employed to form dots, while for the inner area, ink having a relatively high permeation rate (ink that relatively rapidly permeates a print medium; hereinafter referred to as high-permeation ink) and the low-permeation ink are employed for form dots. Since the two types of ink, which have different permeation rates, are employed for printing the inner area, the period required for a print medium to dry can be reduced, compared with when only low-permeation ink having a low permeation rate is employed for printing, and as a result, the printing speed can be increased. Furthermore, compared with when only high-permeation ink is employed for printing the inner area, ink bleed can be reduced, and degradation of the quality of a printed image can be avoided.

When the printing apparatus disclosed in Japanese Patent Laid-Open No. 2002-113850 is used for printing, two types of ink dots having different permeation rates are alternately formed, in a staggered pattern, into the inner area. That is, in the inner area, dots of high-permeation ink and dots of low-permeation ink coexist. However, in Japanese Patent Laid-Open No. 2002-113850, it states simply that dots of the two types of ink, which have different permeation rates, are alternately formed in the inner area of an image being printed by the printing apparatus, and the order in which these two types of ink are ejected to form dots on a print medium is not specified. Therefore, it may logically be inferred that low-permeation ink droplets will be ejected into the print area after high-permeation ink droplets have been ejected. In such a case, the color component, such as a dye or a pigment, of the high-permeation ink deposited on the print medium may be drawn deep into the print medium, and the density of a dot could thereby be decreased. Therefore, the density of a part of a printed image may be insufficient, and the quality of the printed image degraded. This problem occurs when a dye is employed as the color material for an ink, but occurs more frequently when a pigment is employed as the color material.

SUMMARY OF THE INVENTION

While taking the above described problem into account, one objective of the present invention is to provide an ink jet printing apparatus, and an ink jet printing method, for performing printing using both high-permeation ink and low-permeation ink while a reduction in optical density is prevented.

According to an aspect of the present invention, there is provided an inkjet printing apparatus comprising: a print head being able to eject first ink and second ink, the color of which is similar to the color of the first ink and having higher permeation than the first ink, and used for printing an image to the print medium; and a printing controller for controlling ejection of the first ink and the second ink from the print heads, so that only the first ink is ejected and the second ink is not employed for printing in an edge area, that is adjacent to an area where the first ink and the second ink is not ejected, of a printing area corresponding to an area to be printed by at least one of the first ink or the second ink on the print medium, and both the first ink and the second ink are employed, and the first ink is ejected prior to the second ink for printing in a non-edge area that is adjacent to the edge area, of the printing area.

According to an aspect of the present invention, there is provided an ink jet printing method, whereby a print head being able to eject first ink and second ink, the color of which is similar to the color of the first ink and having higher permeation than the first ink, and used for printing an image to the print medium, the ink jet printing method comprising: a printing control step for controlling ejection of the first ink and the second ink from the print heads, so that only the first ink is ejected and the second ink is not employed for printing in an edge area that is adjacent to an area where the first ink and the second ink is not ejected, of a printing area corresponding to an area to be printed by at least one of the first ink or the second ink on the print medium, and both the first ink and the second ink are employed, and the first ink is ejected prior to the second ink for printing in a non-edge area that is adjacent to the edge area of the printing area.

Since the ink jet printing apparatus and the ink jet printing method of this invention can prevent a reduction in optical density, degradation in the quality of a printed image can be avoided.

Further features of the present invention will become apparent from the following description of exemplary embodiments (with reference to the attached drawings).

DESCRIPTION OF THE EMBODIMENTS

An ink jet printing apparatus according to the present invention will now be described while referring to the accompanying drawings.

First Embodiment

Figure 1:
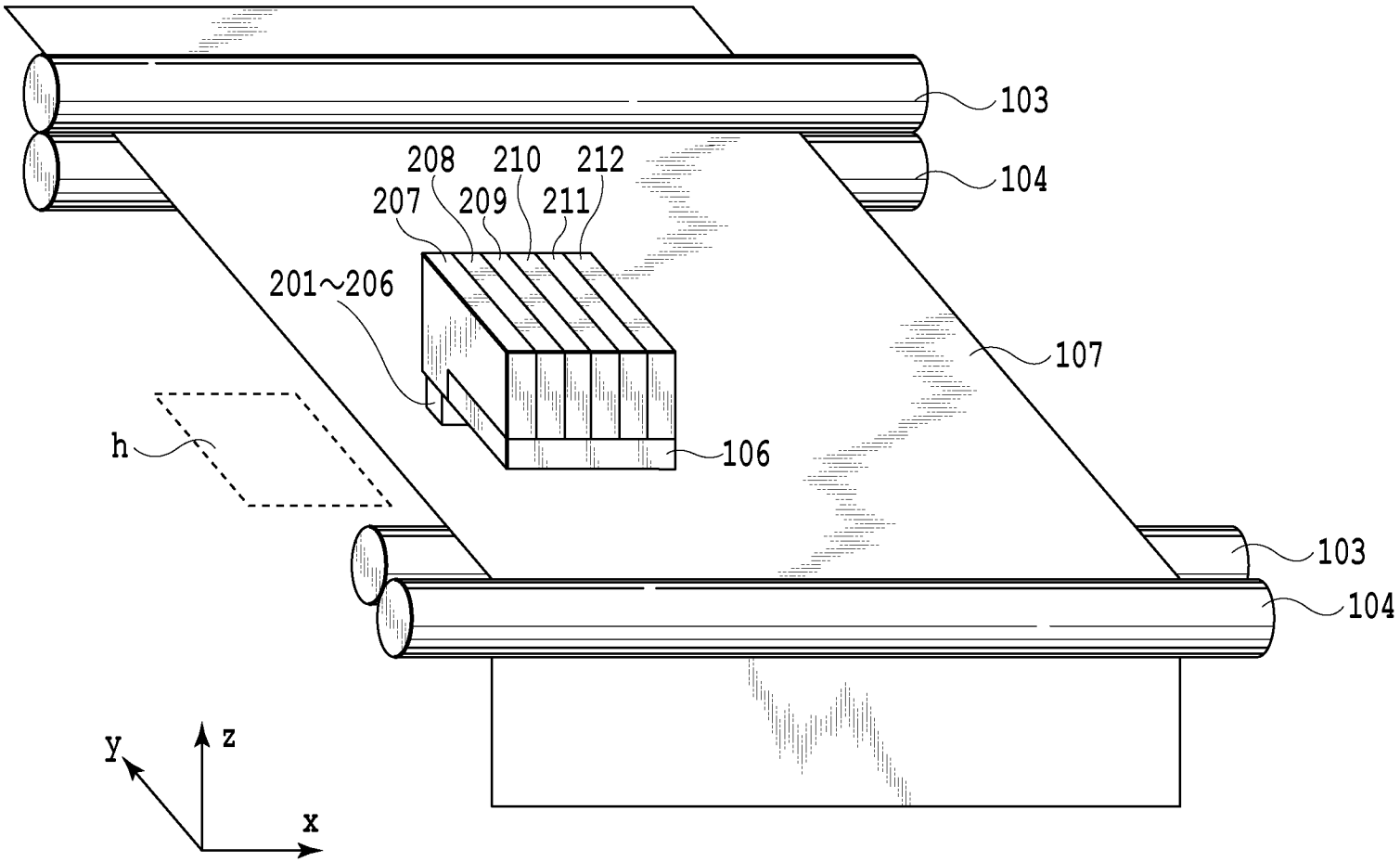
FIG. 1 is a schematic perspective view of an inkjet printing apparatus according to a first embodiment of the present invention.

FIG. 1 is a schematic perspective view of the arrangement of a color inkjet printing apparatus according to a first embodiment of the present invention. The ink jet printing apparatus stores six ink fluids (black (low-permeation ink), black (high-permeation ink), black (low-permeation ink), cyan, magenta and yellow: Ke, Km, Ke, C, M and Y) in ink tanks 207 to 212 so as to supply these ink fluids from these six ink tanks 207 to 212 to print heads 201 to 206. The print heads 201 to 206 are provided in correlation with the six ink fluids to eject ink supplied from the ink tanks 207 to 212. Of the six print heads 201 to 206, the print heads 201, 202 and 203 are employed to eject black ink. Further, in this embodiment, of these print heads that eject black ink, the print heads 201 and 203 eject ink that relatively slowly permeates a print medium (hereinafter referred to as a low-permeation ink), and the print head 202 ejects ink that relatively rapidly permeates (hereinafter referred to as high-permeation ink).

During a printing operation, conveying rollers 103 and auxiliary rollers 104, which are rotated together, sandwich and convey a print medium (a print sheet) 107. Further, the conveying rollers 103 and the auxiliary rollers 104 also hold the print medium 107. Concurrently, a carriage 106, on which the ink tanks 207 to 212 and the print heads 201 to 206 can be mounted, reciprocates in a direction X. Then, while the carriage 106 reciprocates, ink is ejected by the print heads and an image or images are printed on the print medium 107. During a non-printing operation, such as a recovery operation for the print heads 201 to 206, the carriage 106 is moved to and remains at a home position h, described by broken lines in FIG. 1.

When a printing start instruction is entered, the carriage 106, waiting at the home position h in FIG. 1, is moved away from the position h and begins to reciprocate, carrying the print heads 201 to 206 in the direction X. Furthermore, while the carriage 106 is reciprocating, the print heads 201 to 206 eject ink onto the print medium 107 to print an image or images. When the print heads 201 to 206 have completed one pass (one scan), printing have been performed for a portion for which the width is equivalent to the range wherein the ejection ports of the print heads 201 to 206 are arranged.

When printing has been performed in conjunction with scanning performed by the carriage 106 in the main scan direction (positive X direction), the carriage 106 moves in the main scan direction (negative X direction) toward the home position h. During this movement, the print heads 201 to 206 are again moved while ejecting ink onto the print medium 107. During a period extending from the end of a preceding scan to the start of a succeeding scan, the conveying rollers 103 are rotated and convey the print medium 107 in a sub-scan direction (direction Y) that crosses the main scan direction. When the scanning performed by the print heads 201 to 206 and the conveying of the print medium 107 are repeatedly performed, in the described manner, printing of an image on the print medium 107 is completed. This printing operation, performed by ejecting ink from the print heads 201 to 206 is performed by control means that will be described later.

In the above example arrangement, the ink tanks 207 to 212 and the print heads 201 to 206 are mounted as separate units on the carriage 106. However, an arrangement may be employed wherein an integrated cartridge that includes the ink tanks 207 to 212 and the print heads 201 to 206 is mounted on the carriage 106. Further, an arrangement may also be employed wherein a multi-color integrated print head that can eject multiple colors of ink is mounted on a carriage.

Figure 3:
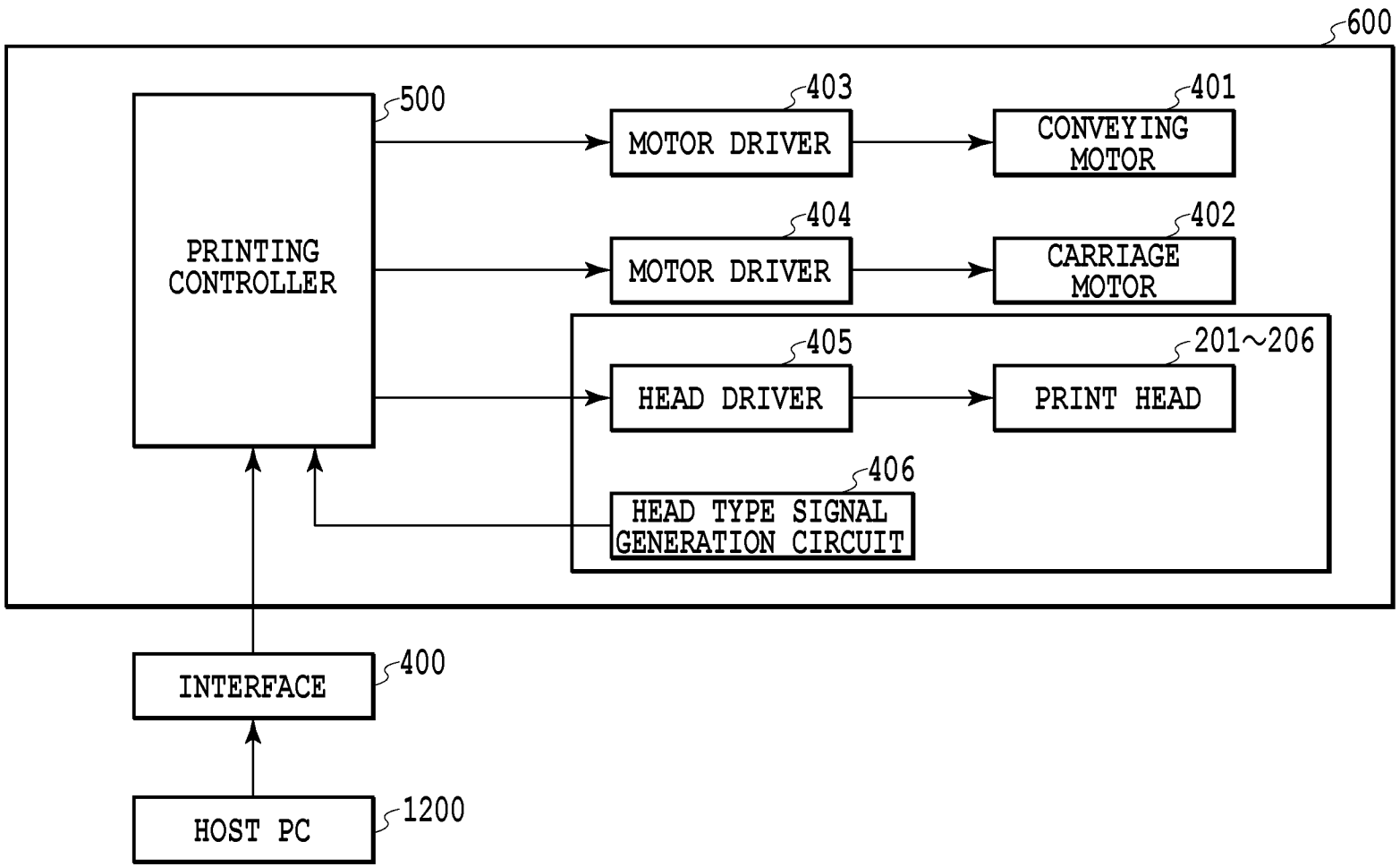
FIG. 3 is a schematic block diagram illustrating the arrangement of a control system for printing performed by the ink jet printing apparatus in FIG. 1.

A data generation method employed for the ink jet printing apparatus will now be described. FIG. 3 is a schematic block diagram illustrating the arrangement of a printing control system for the ink jet printing apparatus in FIG. 1. An ink jet printing apparatus 600 is connected via an interface 400 to a data supply apparatus, such as a host computer (hereinafter referred to as a host PC) 1200. Various data and control signals associated with printing, transmitted from the data supply apparatus, are supplied to a printing controller 500 of the ink jet printing apparatus 600. The printing controller 500 controls motor drivers 403 and 404 and head drivers 405, which will be described later, based on control signals entered via the interface 400. Furthermore, the printing controller 500 processes input image data and a signal received from a head type signal generation circuit 406, which will be described later. A conveying motor 401 is used to rotate the conveying rollers 103, which convey the print medium 107. A carriage motor 402 reciprocally moves the carriage 106 on which the print heads 201 to 206 are mounted. The motor drives 403 and 404 drive the conveying motor 401 and the carriage motor 402, respectively, and the print heads 201 to 206 are driven by head drivers 405, the number of which is equivalent to that of the print heads 201 to 206. Furthermore, the head type signal generation circuit 406 transmits to the printing controller 500 a signal indicating the type and number of the print heads 201 to 206 that are mounted on the carriage 106.

Figure 4:
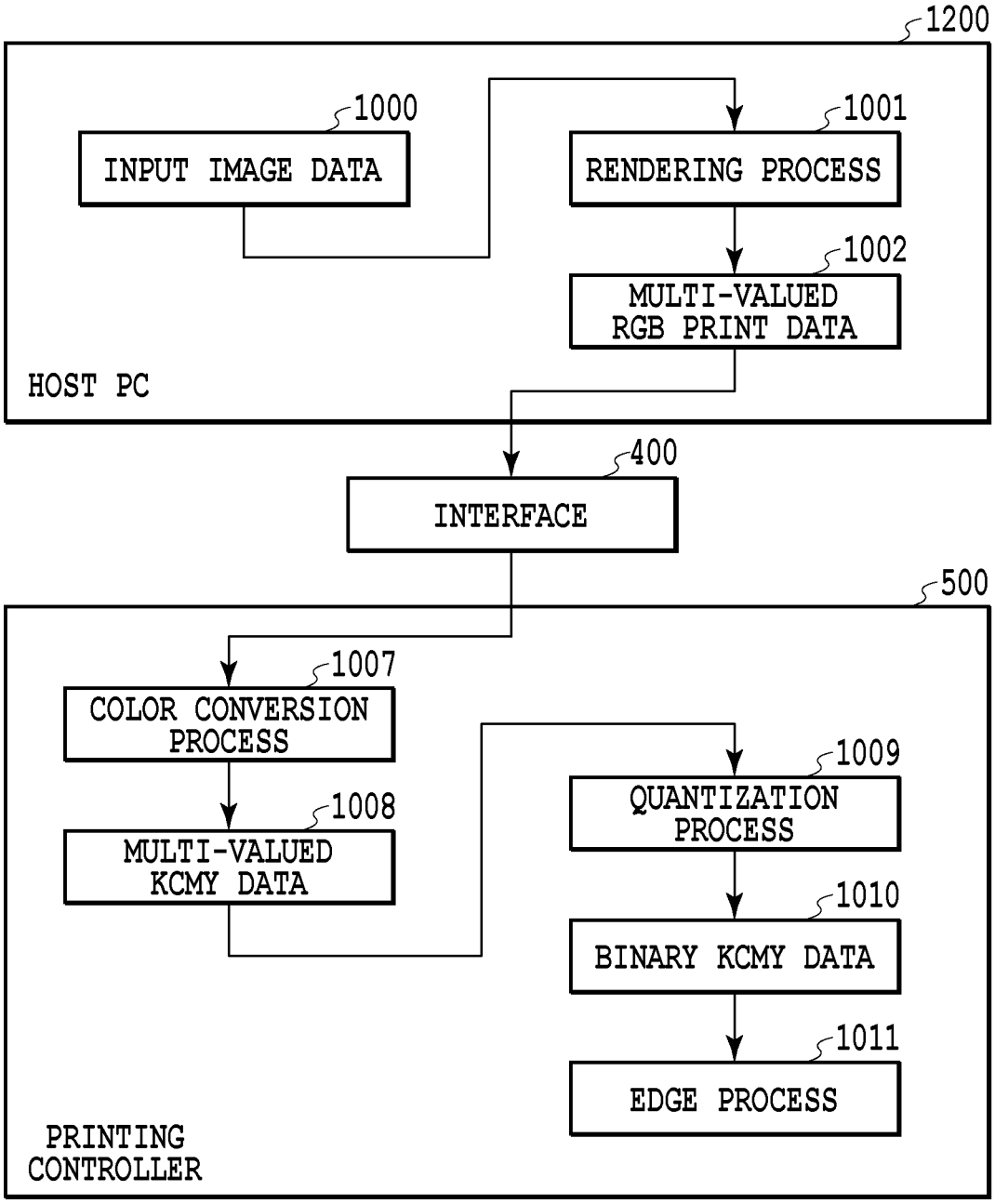
FIG. 4 is a functional block diagram illustrating a schematic arrangement for data transmission during the image data processing performed by an image processing system, which includes the ink jet printing apparatus in FIG. 1 and a host PC.

FIG. 4 is a functional block diagram illustrating a schematic arrangement for image data processing performed by an image processing system that includes the ink jet printing apparatus and the host PC. The printing controller 500 of the ink jet printing apparatus 600 processes data that are transmitted, via the interface 400, by the host PC 1200, wherein a printer driver is installed.

The host PC 1200 receives input image data 1000 from an application program, and performs for the input image data 1000 a rendering process 1001 at a resolution of 1200 dpi (dots/inch). And as a result, multi-valued print RGB data 1002 are generated. In this embodiment, the multi-valued print RGB data 1002 is 256 valued data, and the obtained multi-valued print RGB data 1002 is transmitted to the printing controller 500 of the ink jet printing apparatus 600. The printing controller 500 performs a color conversion process 1007 to convert the multi-valued print RGB data 1002 into multi-valued (256 valued) KCMY data 1008. Then, a quantization process 1009 (e.g., error diffusion) is performed to quantize (binarize) the multi-valued (256 valued) KCMY data 1008, and as a result, the binary KCMY data are obtained. In this embodiment, binary KCMY data are generated that have a resolution of 1200 dpi.

Figure 5:
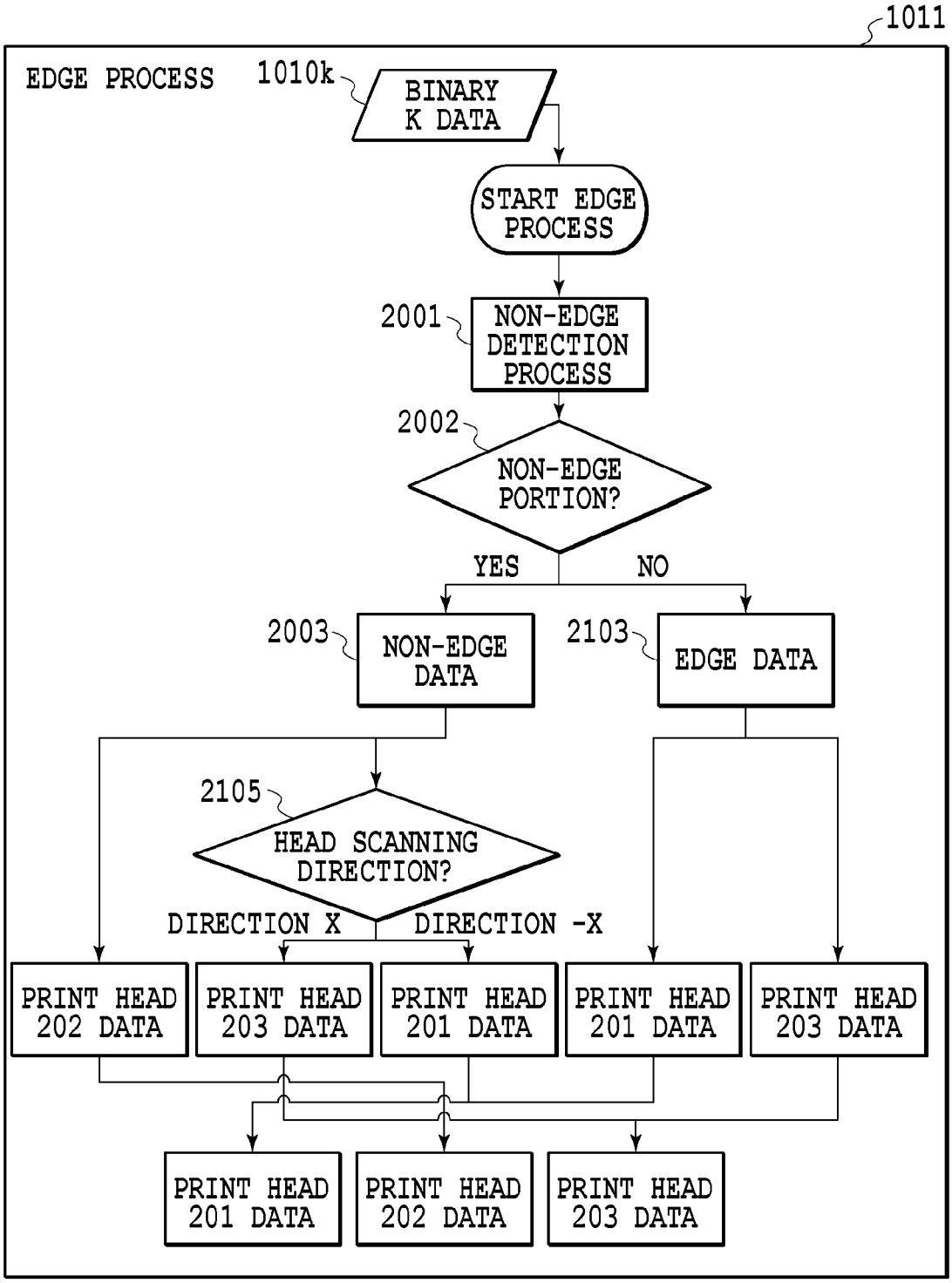
FIG. 5 is a detailed block diagram illustrating a schematic arrangement for transmission of data used to explain the edge processing performed in the block diagram in FIG. 4.

Edge processing is performed for black data in the binary data. FIG. 5 is a diagram showing the edge processing. First, a non-edge detection process 2001 is performed. Of the binary black data, data for a non-edge portion, i.e., non-edge area data 2003, are generated. The binary black data that is not pertinent to non-edge area data is regarded as edge area data 2103. The edge portion is the edge area adjacent to a non-print area where printing is not to be performed, and the non-edge area surrounded by the edge area is a non-edge portion. In this embodiment, of the binary black data, one pixel (one dot) is selected from the outermost portion (external edge) of the targeted print area, and is defined as an edge pixel that is to be printed to form the edge portion. The other data is employed for non-edge area data.

When the edge area data and the non-edge area data are generated, ink is ejected for printing based on the edge area data and non-edge area data. The order in which ink is ejected onto a print medium will now be described while referring to FIGS. 2A to 2C.

Figure 2A:
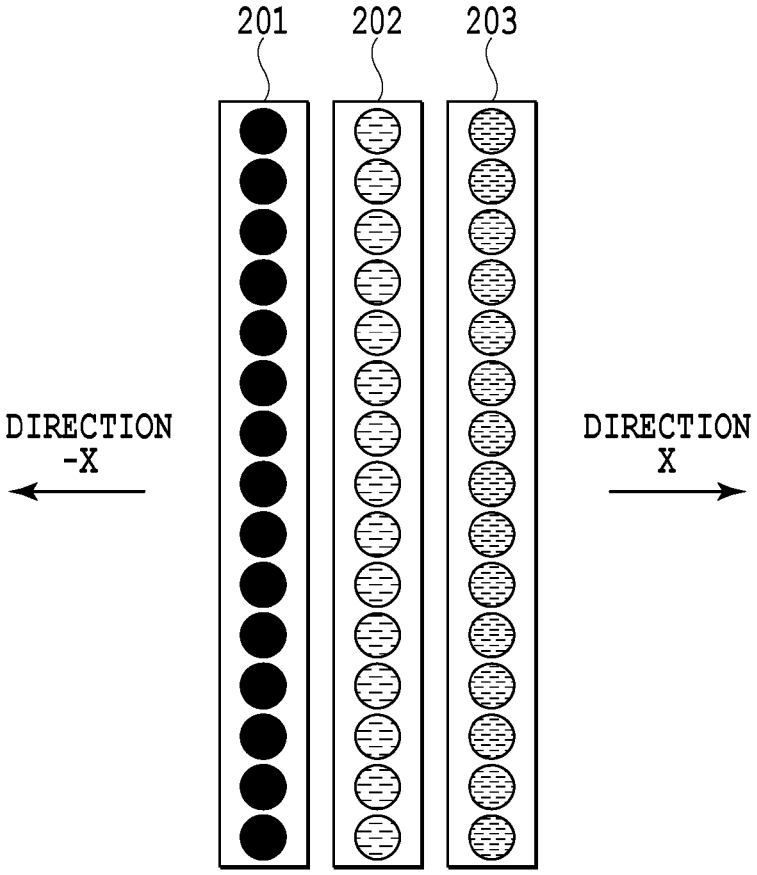
FIG. 2A is a schematic plan view of print heads employed for the ink jet printing apparatus in FIG. 1.

Of the print heads 201 to 206 in FIG. 1, the print heads 201 to 203 that eject black ink are shown in FIG. 2A. Ink to be ejected from the print heads 201, 203 is low-permeation ink (ink that is relatively slow to permeate a print medium; hereinafter referred to as low-permeation ink) (first ink). Ink to be ejected from the print head 202 is high-permeation ink (ink that is relatively fast to permeate a print medium; hereinafter referred to as high-permeation ink) (second ink). The low-permeation ink and the high-permeation ink are visually identified as the same color when these inks are printed on a print medium. The ink jet printing apparatus of this embodiment prepares the print head 201 for ejecting low-permeation ink (first print head), the print head 202 for ejecting high-permeation ink (second print head) and the print head 203 for ejecting low-permeation ink (third print head). That is, in this embodiment, ejection port arrays that are to eject low-permeation ink (first and third ejection port arrays) and an ejection port array that is to eject high-permeation ink (second ejection port array) are provided as ejection port arrays. In this embodiment, a resolution of the ejection ports in an ejection port array arranging direction of the print head is 1200 dpi.

Figure 2B:
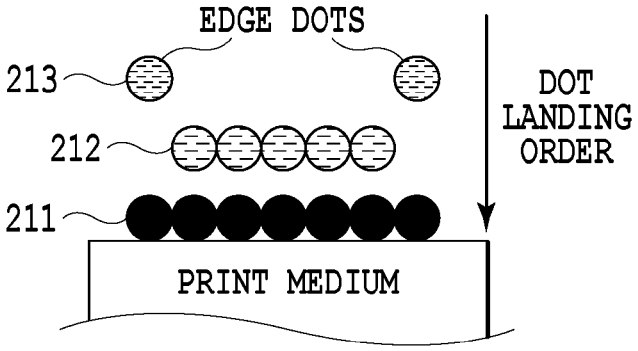
FIGS. 2B and 2C are diagrams for explaining the order in which ink droplets are ejected by the print heads in FIG. 2A.
Figure 2C:
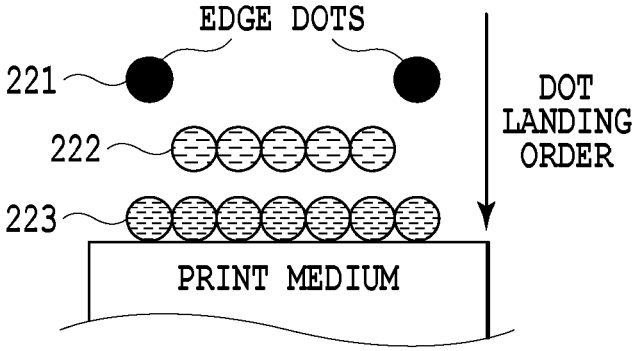

As shown in FIG. 2B, when the print heads are moved in the direction −X, droplets of low-permeation ink (211 in FIG. 2B) are ejected, by the print head 201, onto both the non-edge area (non-edge portion) and the edge area (edge portion). Thereafter, droplets of high-permeation ink (212 in FIG. 2B) are ejected, by the print head 202, onto the non-edge area (non-edge portion). Sequentially, then, droplets of low-permeation ink (213 in FIG. 2B) are ejected, by the print head 203, onto the edge area (edge portion). Then, while moving the print heads in the direction X, as shown in FIG. 2C, droplets of low-permeation ink (223 in FIG. 2C) are ejected, by the print head 203, onto both the non-edge area (the non-edge portion) and the edge area (the edge portion). Then, droplets of high-permeation ink (222 in FIG. 2C) are ejected, by the print head 202, onto the non-edge area (the non-edge portion). Thereafter, droplets of low-permeation ink (221 in FIG. 2C) are ejected, by the print head 201, onto the edge area (the edge portion).

In the printing process for the non-edge area, droplets of the high-permeation ink 212, ejected by the print head 202 during the movement in the direction −X, landed so they overlapped dots of the low-permeation ink 211 that were formed previously. Further, droplets of the high-permeation ink 222, ejected by the print head 202 during movement in the direction X, landed so they overlapped dots of the low-permeation ink 223 that were formed previously. Since the low-permeation inks 211 and 223 are slow to permeate, i.e., the permeation rate for these inks is low, and the dots of the low-permeation inks 211 and 223 remain on the surface of the print medium until droplets of the high-permeation inks 212 and 222 have landed on the print medium. Then, when the low-permeation ink 211 and 223 and the high-permeation inks 212 and 222 on the surface of the print medium blend, the permeation rates of the two inks are averaged. At this time, the permeation rate is increased, and exceeds the permeation rate for the portion that was printed using only the low-permeation ink. Specifically, when the non-edge area of an image is printed first using low-permeation ink having a low permeation rate, and is then printed using a high-permeation ink having a high permeation rate, color materials permeate the print medium better than when printing is performed using only the low-permeation ink, and rub resistance and bleed fastness are improved.

As described above, for printing the non-edge area of a printing image, the ejection of low-permeation ink is performed prior to the ejection of high-permeation ink (non-edge area printing sequence), so that the low-permeation ink and the high-permeation ink on the print medium at least contact each other.

For printing the edge area, ejection of ink is performed by the print heads 201 and 203 that eject low-permeation ink (edge area printing sequence).

In a case wherein an ink color material in an ink being used to print an image is raised too much on the surface of a print medium, and something, such as a finger, inadvertently touches the excessively raised portion formed by the color material on the print medium, there is a possibility that the color material will be smudged and the quality of the image debased. Further, if an ink color material in an ink being used to print images is raised too much on the surface of a print medium, and the characters are subsequently traced using a marker pen, a possibility is that the marker pen will cause the color material at the raised portions to bleed, and the quality of the printed images degraded. However, when the color material or materials appropriately permeate the print medium, the excessive raising of ink on the surface of the print medium does not occur, and when the print medium is touched by a finger or printed images are traced using a marker pen, the printed image or images will not be smudged, and a high image quality can be maintained for the image or images.

Further, when printing is performed for the non-edge area according to the order in which low-permeation ink and high-permeation ink are ejected, a greater optical density for a printed image is provided than when high-permeation ink ejection is performed before the slow-drying, or when only the ejection of high-permeation ink is performed.

Printing for the non-edge area data 2003 is performed using both the print heads that eject low-permeation ink and the print heads that eject high-permeation ink. As for the ejection of low-permeation ink, the print heads employed for printing are changed, depending the direction in which scanning is performed by the entire print head unit and the carriage. When the print head unit moves in the direction X, the print head 203 ejects the low-permeation ink 223, as shown in FIG. 2C, or when the print head unit moves in the direction −X, the print head 201 ejects the low-permeation ink 211, as shown in FIG. 2B. In this manner, printing is performed by allocating the ejection of the low-permeation ink to two print heads. As a result, as shown in FIG. 2A, regardless of the scan direction for the print head unit, either the print head 201 or 203, which ejects low-permeation ink, is positioned, in the scan direction, in front of the print head 202 that ejects high-permeation ink. Therefore, the ink jet printing apparatus performs printing by first ejecting ink from the print head 201 or the print head 203, and then from the print head 202. That is, regardless of the scan direction for the print heads, printing is initiated using low-permeation ink, and is continued, using high-permeation ink thereafter. As described above, when the print head 201 is located forward in the scan direction, the printing sequence (first printing sequence) is employed for ejecting ink from the print heads 201 and 202, and for printing the non-edge area. And when the print head 203 is located forward in the scan direction, the printing sequence (second printing sequence) for ejecting ink from the print heads 202 and 203 is employed for printing the non-edge area.

In this embodiment, two print heads, both of which eject low-permeation ink, are employed for printing the non-edge area data 2003; however, only one print head may be so employed. For example, when the print heads are moved in the direction X, only the print head 201 may eject ink to print the non-edge area data 2003. Furthermore, when the print heads are moved in the direction −X, only the print head 203 may eject ink for printing the non-edge area data 2003. As obtained effects, bleeding of the non-edge area where high-permeation ink droplets first landed is not actually visible.

Figures 6A, 6B, 6C, 6D, 6E, 6F, 6G, 6H, 6I, 6J, 6K, 6L:
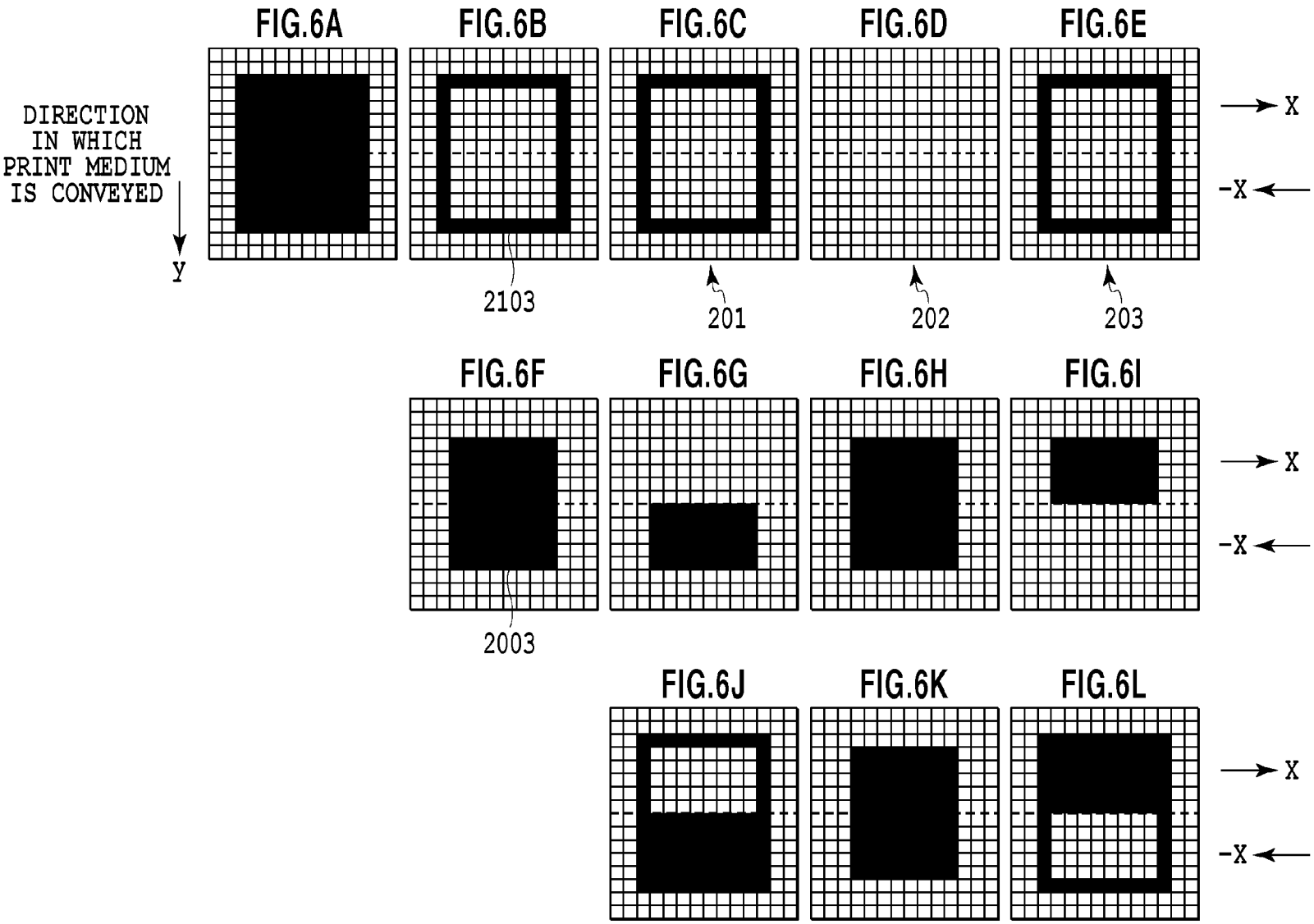
FIGS. 6A to 6L are explanatory diagrams for explaining a data distribution process for allocating, for the individual print areas, data that are to be printed by corresponding print heads in the first embodiment.
Figures 7, 7A:
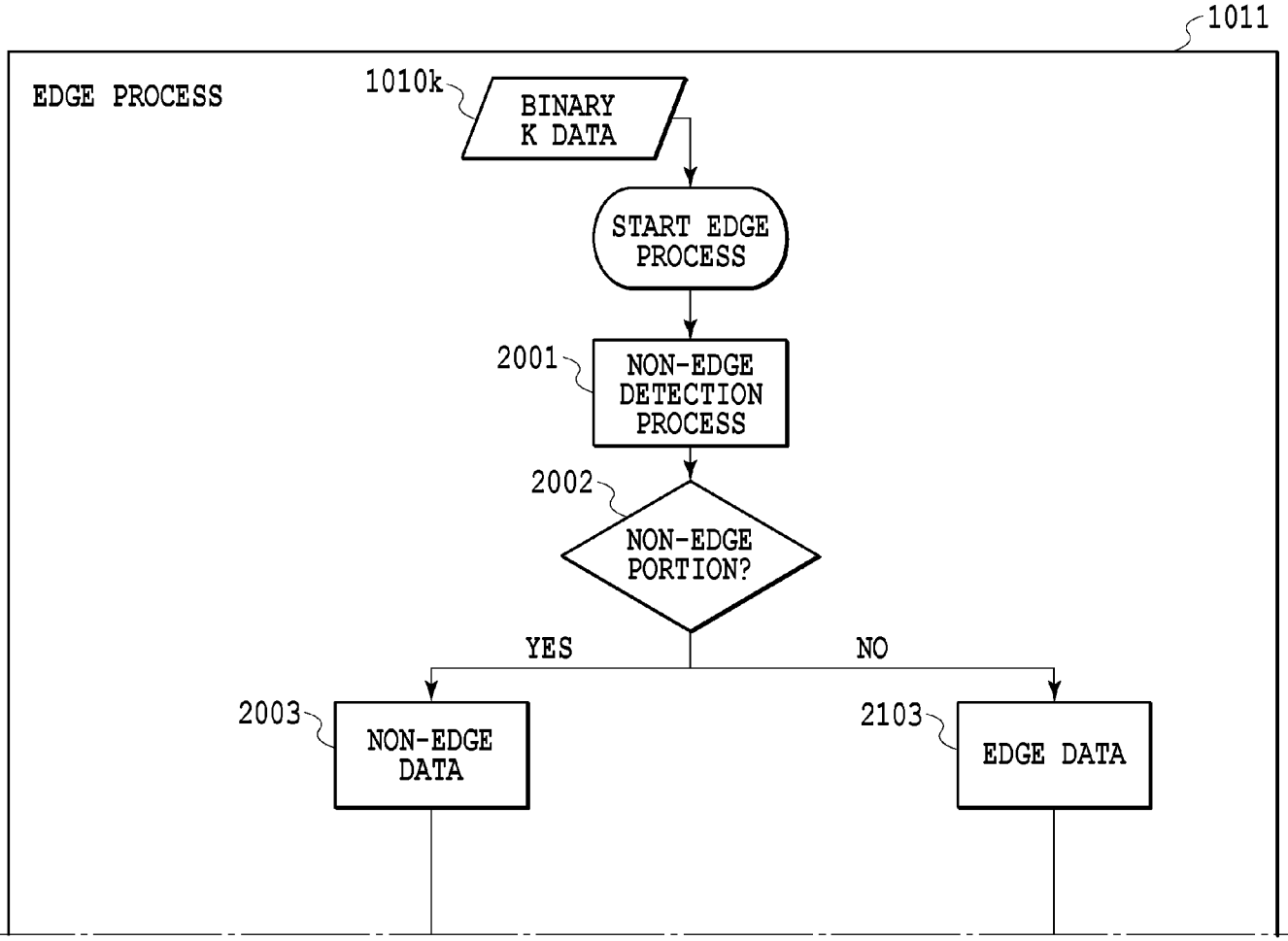
FIG. 7 is a diagram showing the relationship between FIGS. 7A and 7B.
FIGS. 7A and 7B are block diagrams illustrating a schematic arrangement for transmission of data used to explain the edge processing performed, during a printing operation, by an ink jet printing apparatus according to a second embodiment of the present invention.
Figure 7B:
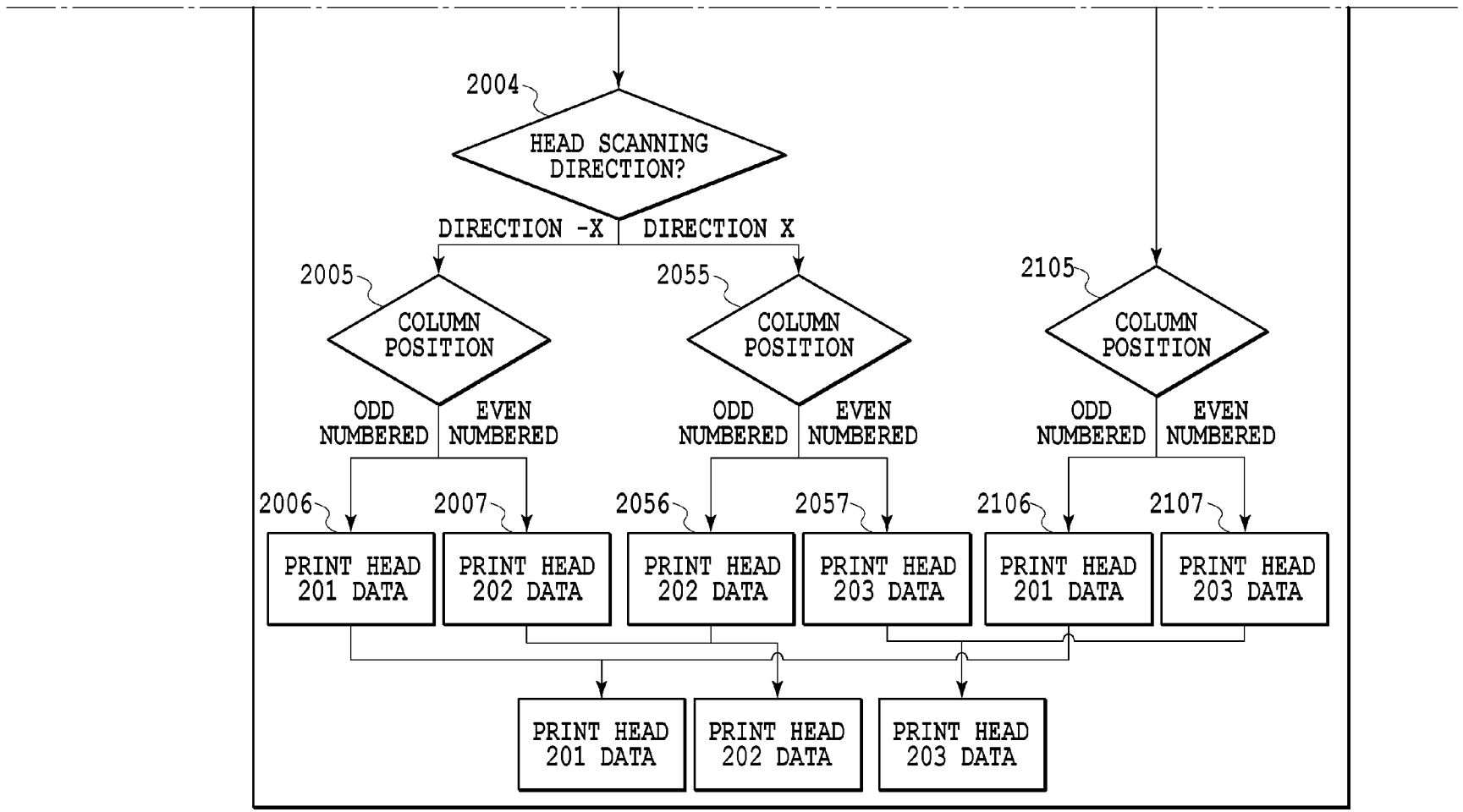

The data distribution process performed by allocating data to the print heads 201, 202 and 203 for the individual areas will now be described while referring to FIGS. 6A to 6L. One cell in an area indicates one pixel for print data, and one ink dot is ejected for one pixel. FIGS. 6A to 6L are explanatory diagrams for the process for allocating data to the print heads 201 to 203, which will be described later, and FIGS. 6C, 6G and 6J correspond to images printed by the print head 201. Similarly, FIGS. 6D, 6H and 6K correspond to images printed by the print head 202, and FIGS. 6E, 6I and 6L correspond to images printed by the print head 203. FIG. 6A is a diagram showing the entire print data for the targeted print area employed in this embodiment. The targeted print area in FIG. 6A represents an image that includes the edge area, which is an area inward from the outer edge a distance equivalent to a predetermined number of pixels, and the non-edge area that is located inside the edge area. Broken lines laterally shown in the center in FIGS. 6A to 6L indicate the boundary between areas where the scan direction of the print heads differs. The portions above the broken lines are pixels printed when the scan direction of the print heads is the direction X (right in FIGS. 6A to 6L), and the portions below the broken lines are pixels printed when the scan direction of the print heads is the direction −X (left in FIGS. 6A to 6L). When the non-edge detection process 2001 is performed, binary print data are employed to generate the non-edge area data 2003, which are employed for forming pixels in FIG. 6F, and the edge area data 2103, which are employed for forming pixels in FIG. 6B.

The process for printing the edge area data 2103 image shown in FIGS. 6B to 6E will now be described. Printing for the edge area data 2103 shown in FIG. 6B is performed while employing the print heads 201 and 203 that eject low-permeation ink. When the print head unit is moved in the direction X, the print head 203 is located in front of the print head 201, in the scan direction. Therefore, during one scan performed for the printing of the targeted print area, the upper half of an image shown in FIG. 6E is printed, by the print head 203, on a predetermined area, and sequentially thereafter, the upper half of the image shown in FIG. 6C is printed on the same area by the print head 201. When the scanning in the direction X has been completed, the scan direction is reversed, and the print head unit begins to move in the direction −X. Then, as the print heads are moved in the direction −X, the print head 201 is located in front of the print head 203, in the scan direction. Therefore, the lower half of the image shown in FIG. 6C is printed on a predetermined area by the print head 201, and sequentially following, the lower half of the image in FIG. 6E is printed on the same area by the print head 203.

The process for printing the non-edge area data 2003 in FIGS. 6F to 6I will now be described. The non-edge area data 2003 shown in FIG. 6F are image print data for an area obtained by excluding, from the print data for an image shown in FIG. 6A, the portion for the edge area data 2103.

Thus, the non-edge area data 2003 image in FIG. 6F is printed by employing both the print head 201, 203, which ejects low-permeation ink, and the print head 202, which ejects high-permeation ink. During this printing process, according to the established printing order for the ejection of ink onto the individual print areas for the non-edge area data 2003, printing performed using the high-permeation ink sequentially follows printing performed using the low-permeation ink.

When the print heads are moved in the direction X, printing is performed for the upper half of the area in FIGS. 6F to 6I. During this time, the print head 203 ejects low-permeation ink, and the print head 202 ejects high-permeation ink. At this time, in the scan direction, the print head 203 is located in front of the print head 201. Therefore, during a single scan, performed for the printing of the targeted print area, low-permeation ink is ejected onto a predetermined area by the print head 203, and sequentially thereafter, high-permeation ink is ejected onto the same area by the print head 202.

When scanning in the direction X has been completed, the scan direction is reversed and the print heads begin to move in the direction −X. While the print heads are being moved in the direction −X, printing is performed using the print head 201, which ejects low-permeation ink, and the print head 202, which ejects high-permeation ink. At this time, in the scan direction, the print head 201 is located in front of the print head 202. Therefore, during a single scan performed in the direction −X, for printing the targeted print area, low-permeation ink is ejected, by the print head 201, onto a predetermined area, and sequentially thereafter, high-permeation ink is ejected, by the print head 202, onto the same area. As described above, of the non-edge area data 2003 shown in FIG. 6F, data for the upper half portion that is to be printed during the X-directional scan is allocated to the print head 202, which ejects high-permeation ink, and the print head 203, which ejects low-permeation ink. The data allocated to the print head 202 is print data for the upper half portion of an image shown in FIG. 6H, whereas the data allocated to the print head 203 is print data for the upper half image shown in FIG. 6I. Further, of the non-edge area data 2003, data for the lower half portion that is to be printed during the −X directional scanning is allocated to the print head 201, which ejects low-permeation ink, and the print head 202, which ejects high-permeation ink. Furthermore, the data allocated to the print head 201 is print data for the lower half image shown in FIG. 6G, whereas the data allocated to the print head 202 is print data for the lower half portion of the image shown in FIG. 6H.

As a result, data to be printed by the individual print heads are as follows. Data printed by the print head 201 is the logical sum (FIG. 6J) of the edge area data in FIG. 6C and the non-edge area data in FIG. 6G. Data printed by the print head 202 is the logical sum (FIG. 6K) of the edge area data in FIG. 6D and the non-edge area data in FIG. 6H. And data printed by the print head 203 is the logical sum (FIG. 6L) of the edge area data in FIG. 6E and the non-edge area data in FIG. 6I.

The present invention also includes a program that employs the above described ink jet printing method, to control an ink jet printing apparatus, and permits the ink jet printing apparatus to eject ink onto a targeted print area on a print medium and to perform printing.

The following ink compositions are employed for this embodiment. The ratios of the individual components are represented using parts by mass (the total for all the components is 100 parts by mass).

(High-Permeation Ink)

| | |
|---|---|
| Pigment dispersion | 50 parts by mass |
| Glycerine | 10 parts by mass |
| Polyethylene glycol 1000 | 1 part by mass |
| Acetylenol E100 (trademark by Kawaken Fine Chemicals Co., Ltd.) | 1 part by mass |
| Water | Remaining parts |

(Low-Permeation Ink)

| | |
|---|---|
| Pigment dispersion | 50 parts by mass |
| Glycerine | 10 parts by mass |
| Polyethylene glycol 1000 | 1 part by mass |

-continued

| | |
|---|---|
| Acetylenol E100 (trademark by Kawaken Fine Chemicals Co., Ltd.) | 0.03 parts by mass |
| Water | Remaining parts |

The pigment dispersion described above was obtained through the following process.

[Pigment Dispersion]

Carbon black of 10 g, for which the surface area is 230 $m^2/g$ and the DBP absorption is 70 ml/100 g, and p-aminobenzoic acid of 3.41 g were properly mixed in water of 72 g, and thereafter, nitric acid of 1.62 g was dripped into the obtained mixture, which was then stirred at a temperature of 70° C. After several minutes had elapsed, a solution wherein sodium nitrite of 1.07 g was dissolved in water of 5 g was added to the mixture, and the resultant mixture was stirred for one hour. The obtained slurry was filtered through qualitative Toyo Roshi filter paper No. 2 (produced by Advantis), and pigment particles were rinsed sufficiently and dried in an oven at a temperature of 90° C., and thereafter, water was added to the pigment. As a result, an aqueous pigment solution having a pigment density of 10 parts by mass was prepared. When the above described method was employed, a pigment dispersion was obtained that contained anionically charged, self-dispersible carbon black, wherein a hydrophilic group was coupled to the surface via a phenyl group.

The ink composition employed for this embodiment is merely an example for which the present invention can be applied, and two types of ink that have similar colors and have different permeation rates may be employed.

The color material employed for this embodiment is called a self-dispersible pigment that includes a hydrophilic group attached to pigment particles. There is another type of color material, called a resin dispersed pigment, where a resin is attached to pigment particles and the hydrophilic group of the resin exhibits a water-soluble property. According to the study of the present inventors, the self-dispersible pigment is more appropriate for the present invention, but the effects of the present invention were also obtained using the resin dispersed pigment.

A difference in permeation between high-permeation ink and low-permeation ink is defined depending on the surface tension. The effects of the present invention could be obtained when the surface tension of high-permeation ink was smaller than the surface tension of low-permeation ink, and when the surface tension of high-permeation ink was between equal to or greater than 20 mN/m and equal to or smaller than 40 mN/m, and the surface tension of low-permeation ink was between equal to or greater than 40 mN/m and equal or smaller than 60 mN/m. In this embodiment, surfactant Acetylenol E100 (ethylene oxide-2, 4, 7, 9-tetramethyl-5-decyne-4, 7-diol)) (product name by Kawaken Fine Chemicals Co., Ltd.) was employed to control the surface tension. The permeation rates of high-permeation ink and the permeation of low-permeation ink are relatively changed using the surfactant; however, another solvent may be employed.

As described above, since the edge area (edge portion) is printed using low-permeation ink, bleeding of a printed image can be reduced, and the density of the image can be increased while degrading of the image quality is avoided. Furthermore, the non-edge area (non-edge portion) is printed by ejecting first low-permeation ink and then high-permeation ink, the permeation rate of the high-permeation ink in the print medium can be suppressed. Therefore, a large amount of the ink color material can be retained on the surface of the print medium, and the optical density of the non-edge area can be increased. Compared with when printing is performed only by using low-permeation ink, a probability that the ink color material is raised and maintained on the surface of the print medium is reduced. Therefore, a damage on a printed image and degrading of the image quality, which will occur when the hand of a user, or the other thing, touches the color material of ink that remains on the surface of the print medium, are also reduced. When the amount of ink that rises on the surface of the print medium is reduced, rub fastness and bleed fastness for a printed image can be improved.

Second Embodiment

The printing processing performed by an ink jet printing apparatus according to a second embodiment of the present invention will now be described. As for portions that correspond to those in the first embodiment, the same reference numerals used for the first embodiment are also provided to omit a description for these portions, and only different portions will be described below.

In the printing processing for the first embodiment, low-permeation ink is ejected to the edge portion, while as for the non-edge portion, low-permeation ink is ejected first on to the entire area, and then high-permeation ink is ejected on the same area to superimpose ink. In contrast, according to the second embodiment, the printing processing is performed by thinning out data partially for the edge portion and the non-edge portion in order to increase throughput. Sequentially, at the non-edge portion, dots of low-permeation ink and dots of high-permeation ink are superimposed and become complementary to each other, so that the overall printed image is obtained. In this embodiment, printing is so performed that the area printed using low-permeation ink and the area printed using high-permeation ink are adjacent to each other, at the non-edge portion.

For sequential ink ejection from individual ejection ports, a predetermined time interval is required for application of energy to the print heads for the ejection of ink. Further, after ink has been ejected, an ink refilling period is required for supplying ink to the individual nozzles. Furthermore, at each elapse of a predetermined time period, a period for transmitting a predetermined amount of print data to a storage area is required. The number of dots (hereinafter also referred to as a scanning resolution) one print head can print during one scan strongly depends on the structure of a print head. When an increase in the scanning resolution of a print head by changing of the structure of the print head is desired, the structure of the print head must be greatly changed, and the manufacturing cost of the ink jet printing apparatus raised accordingly.

Therefore, in this embodiment, the number of dots one print head will print during one scan in the scan direction (the direction X or the direction −X) is designated as 1/n of that when only one print head is employed for printing. Since only one print head is insufficient for covering the whole amount of print data, in this embodiment a plurality of print heads are arranged, and print data is assigned to these print heads, so that use of the print data can be completed by the interaction of a plurality of print heads. Especially in this embodiment, the number of dots one print head can print during one scan in the scan direction is designated as being ½ that when only one print head is employed for printing. Further, the number of pixels printed by each of the print heads is also ½ the number of pixels that are formed when ink is ejected from only one print head. As described above, in this embodiment, print data based on which of the print heads eject ink onto a print medium is allocated to the individual print heads, and the number of pixels for print data is reduced in consonance with the number of ink droplets ejected by each print head.

Figures 8A, 8B, 8C, 8D, 8E, 8F, 8G, 8H, 8I, 8J, 8K, 8L:
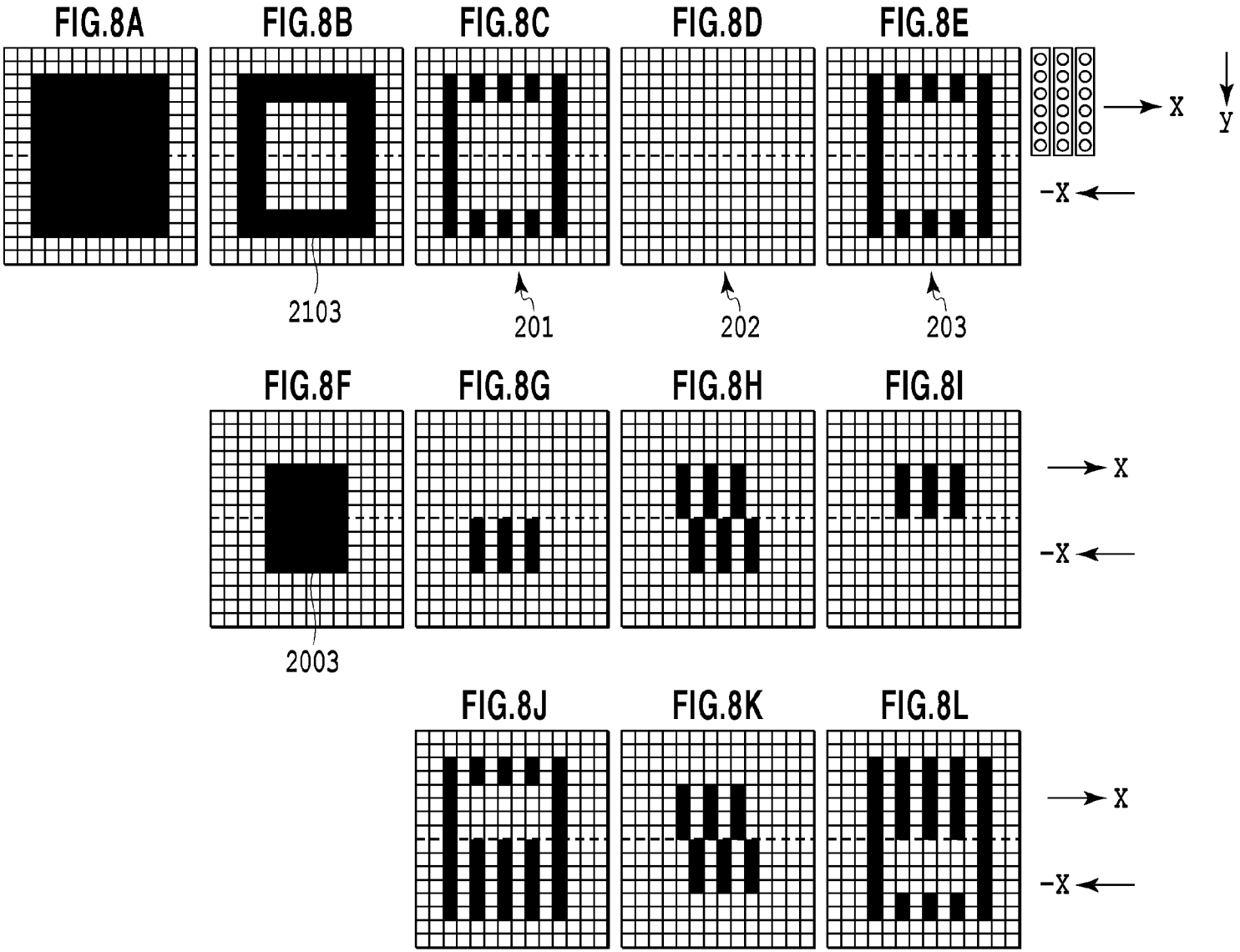
FIGS. 8A to 8L are explanatory diagrams for explaining a data distribution process for allocating, for the individual print areas, data that are to be printed in the second embodiment.
Figures 9A, 9B, 9C, 9D, 9E, 9F, 9G, 9H, 9I, 9J, 9K, 9L:
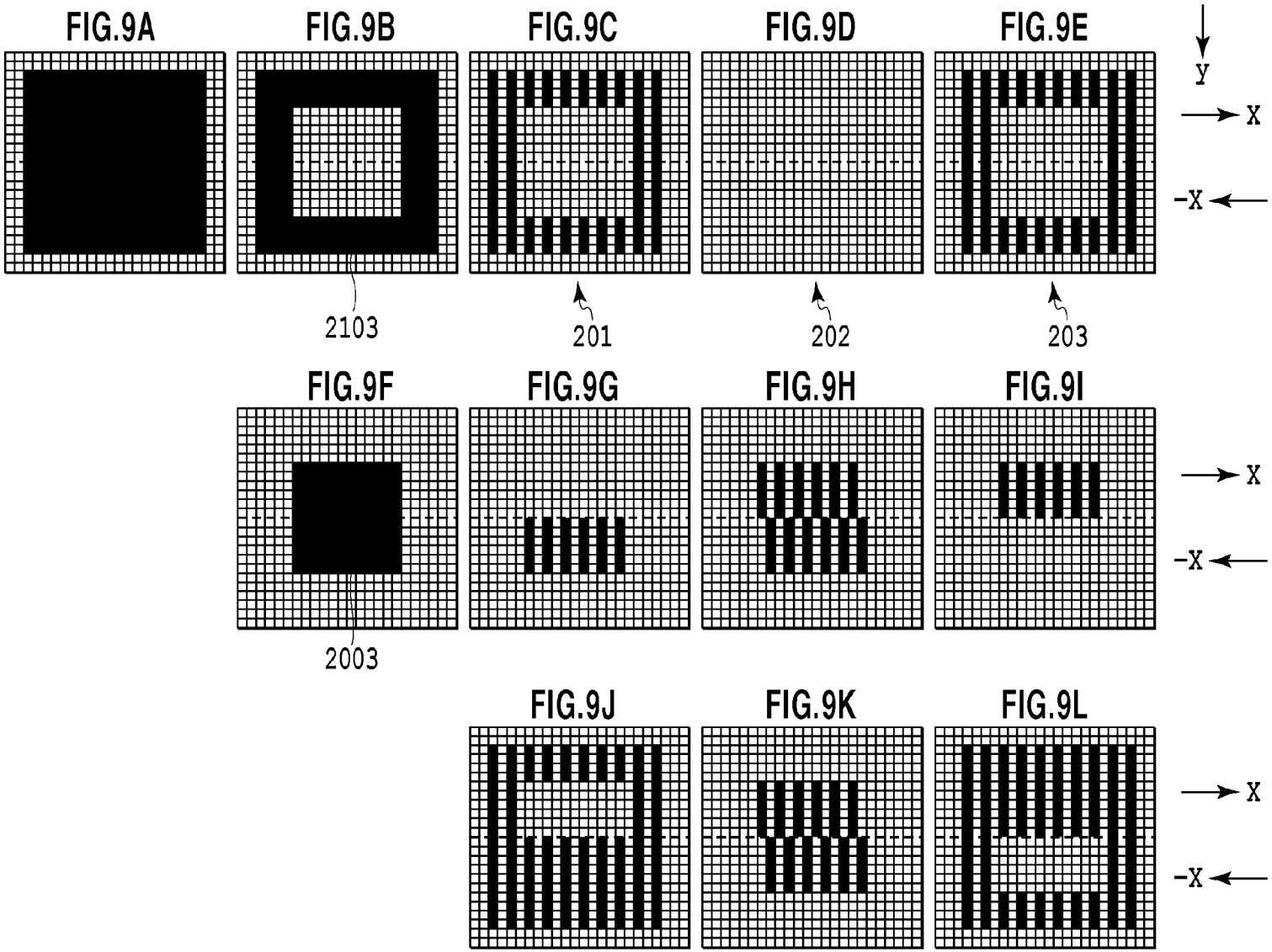
FIGS. 9A to 9L are explanatory diagrams for explaining a data distribution process for allocating, for the individual print areas, print data that are to be printed in a third embodiment of the present invention.

Since the processing in the second embodiment differs from the processing in the first embodiment in the edge process and the following processes, the edge process will be described while referring to FIGS. 7A and 7B and FIGS. 8A to 8L. For this process, binary black data for the entire area is shown in FIG. 8A. A lateral broken line shown in the center of FIGS. 8A to 8L indicates the boundary of areas for which the scan direction of the print heads differ. Pixels in the area above the broken line are those to be printed when the print heads move in the direction X (right in FIGS. 8A to 8L), and pixels in the area below the broken line area those to be printed when the print heads move in the direction −X (left in FIGS. 8A to 8L). In this embodiment, the length of the print heads 201, 202 and 203 in the direction in which a print medium is to be conveyed is half the vertical length from one end to the other end of the grid shown in FIG. 8A. Therefore, the length for the print heads 201, 202 and 203 is equal to the vertical length from the broken line in FIGS. 8A to 8L to either end of the grid.

FIGS. 8A to 8L are diagrams for explaining the process for assigning print data to the print heads 201 to 203, which will be described later in detail. Print data shown in FIGS. 8C, 8G and 8J correspond to print data to be printed by the print head 201. Similarly, print data shown in FIGS. 8D, 8H and 8K correspond to print data to be printed by the print head 202, and print data shown in FIGS. 8E, 8I and 8L correspond to print data to be printed by the print head 203.

First, the non-edge portion detection process 2001 is performed. At first, for binary black data, data for the non-edge area, i.e., the non-edge area data 2003, is generated. The other data in the binary black data that does not correspond to the non-edge portion is regarded as the edge area data 2103. The non-edge area data 2003 and the edge area data 2103 obtained in the non-edge portion detection process 2001 are shown in FIGS. 8F and 8B. In this embodiment, the width of the edge area (edge portion) is equivalent to two pixels.

The edge area data 2103 for this embodiment is assigned to two print heads in accordance with the column positions for the data 2103. The edge area data 2103 for odd-numbered columns are printed by the print head 201, and the edge area data 2103 for even-numbered columns are printed by the print head 203. Here, an "odd-numbered column" or an "even-numbered column" represents a column in data that is located at an odd-numbered or an even-numbered position from the leftmost column.

The non-edge area data 2003 is assigned to the three print heads in accordance with not only the column positions for the data 2003, but also the scan directions of the carriage 106 and the print heads 201 to 206. When printing for the non-edge portion is performed in the scan direction X, as shown in FIGS. 8H and 8I, data for odd-numbered columns are printed by the print head 202 and data for even-numbered columns are printed by the print head 203. When printing is performed in the scan direction −X, as shown in FIGS. 8G and 8H, data for odd-numbered columns are printed by the print head 201 and data for even-numbered columns are printed by the print head 202.

For the printing of the edge area data 2103 in FIG. 8B, data for odd-numbered columns in FIG. 8C are printed by the print head 201 in accordance with the column positions, and the data for even-numbered columns in FIG. 8E are printed by the print head 203. As a result, all of the edge area data 2103 are printed using low-permeation ink.

When the non-edge area data 2003 in FIG. 8F is to be printed in the scan direction X, i.e., printing for the portion above the broken line is to be performed, data for even-numbered columns are first printed by the print head 203, and data for odd-numbered columns are printed by the print head 202 during the same scan. When printing is performed in the scan direction −X, i.e., printing is performed for the portion below the broken line, data for odd-numbered columns are printed by the print head 201, and then data for even-numbered columns are printed by the print head 202. As described above, printing with low-permeation ink is performed by the print head located forward in the scan direction, and then, during the same scan, printing with high-permeation ink is performed by the backward located print head in the scan direction. Therefore, printing is performed by ink ejection in the order low-permeation ink and high-permeation ink.

The print data that correspond to either the upper or lower portion of the non-edge area data 2003 are shown in FIGS. 8G to 8I. The data for the non-edge area data 2003 printed by the print head 201 is shown in FIG. 8G, the data printed by the print head 202 is shown in FIG. 8H, and the data printed by the print head 203 is shown in FIG. 8I. Thus, in the second embodiment, print data to be printed by the individual print heads are as follows. The data to be printed by the print head 201 is the logical sum (FIG. 8J) of the edge area data in FIG. 8C and the non-edge area data in FIG. 8G. The data to be printed by the print head 202 is the logical sum (FIG. 8K) of the edge area data in FIG. 8D and the non-edge area data in FIG. 8H. The data to be printed by the print head 203 is the logical sum (FIG. 8L) of the edge area data in FIG. 8E and the non-edge area data in FIG. 8I.

As shown in FIGS. 8A to 8L, the data to be printed by the print heads 201 to 203 while scanning are those extracted in the scan direction, and compared with the print data in the first embodiment, half of the data that can be printed during one scan are printed. Therefore, a data transfer period for transferring data to a data storage area and an ink refilling period in each scan can be reduced to half, and the scanning speed of the print heads can be increased to double. For example, when the ink jet printing apparatus of the first embodiment has a scanning resolution of 1200 dpi and a scanning speed of 25 ips (inches/second), the ink jet printing apparatus requires only a reduced scanning resolution of 600 dpi in the second embodiment. Accordingly, the scanning speed of the print head can be increased up to 50 ips, and the printing time can be reduced, in the second embodiment. Therefore, when the printing method of this embodiment is employed, the scanning speed of the print heads can be increased, and the throughput for printing can be improved.

In the embodiment, low-permeation ink is first ejected to the non-edge portion (non-edge area), and extracted data are printed in accordance with the positions of columns. And thereafter, high-permeation ink is ejected to print area in which ink ejection by the low-permeation ink is extracted. At this time, the area (first print area) printed using low-permeation ink and the area (second print area) printed using high-permeation ink at least partially contact each other. When the first print area printed using low-permeation ink and the second print area printed using high-permeation ink contact each other, the low-permeation ink and the high-permeation ink are blended on the pertinent portion on the surface of the print medium. As a result, the rub resistance and the bleed fastness of the non-edge area are improved and the optical density of the printed image can be increased.

Further, for improving throughput, when the ejection of ink is to be performed in the order low-permeation ink and high-permeation ink for bi-directional printing in the direction X and the direction −X, two print heads that eject low-permeation ink and high-permeation ink are required for either printing direction. Therefore, a total of four print heads that eject first low-permeation ink and then high-permeation ink are generally required for printing in the direction X and in the direction −X. However, according to the print head arrangement of the ink jet printing apparatus of this embodiment, only one print head that ejects high-permeation ink is prepared. That is, the single print head that ejects high-permeation ink is employed for printing in the scan direction X and for printing in the scan direction −X. With this arrangement, the number of print heads that eject high-permeation ink is reduced, and the configuration of the ink jet printing apparatus is simplified. As a result, the size and the manufacturing cost of the ink jet printing apparatus can be reduced.

In this embodiment, for the printing of the non-edge area (non-edge portion), ink is not ejected from the rearmost print head in a line, i.e., the print head 203 at the time of scanning in the direction −X or the print head 201 at the time of scanning in the direction X. However, the present invention is not limited to this arrangement. Ejection of ink from the rearmost print head might deteriorate rub resistance and bleed fastness, but so long as such deterioration is within a tolerable range, ink may be ejected from the rearmost print head. In this case, the optical density of a printed image can be increased more. Whether the rearmost print head should be employed for printing can be designated for each ink jet printing apparatus in the design stage.

As described above, the non-edge area (non-edge portion) is divided into columns, and low-permeation ink and high-permeation ink are ejected to print the individual columns. At this time, unlike in the first embodiment wherein low-permeation ink and high-permeation ink are ejected onto the same positions (pixels) in the non-edge area of a print medium, so as to superimpose the high-permeation ink on the low-permeation ink, during ink ejected onto the print medium, these inks need not be ejected onto the same positions in the non-edge area, and may be ejected onto different positions. Since it is essential for this invention that low-permeation ink be ejected prior to the high-permeation ink onto the non-edge area, the ejection of ink should be performed so that on a print medium, dots of low-permeation ink are formed adjacent to dots of high-permeation ink. Further, data may be generated based on which the individual print heads eject ink, so that at least part of the low-permeation ink dots and the high-permeation ink dots overlap each other on the print medium. When the printing operation is performed in this manner, the effects provided by of the present invention can also be obtained. In this embodiment, dots formed using high-permeation ink and dots formed using low-permeation ink are separated, for the individual columns; however, the present invention is not limited to this pattern. Dots formed of high-permeation ink and dots formed of low-permeation ink may be arranged either in a checkerboard pattern, or in some other pattern.

Third Embodiment

The printing processing performed by an ink jet printing apparatus according to a third embodiment of the present invention will now be described. As for portions that correspond to those in the first and second embodiments, the same reference numerals used for the first and second embodiments are also provided to avoid the need for a description for these portions, and only portions that are different will be described below.

In the first and second embodiments, to print an image, a width equivalent to one or two pixels from the outer edge is employed as the edge portion of a printing area. In this embodiment, four pixels are selected as the edge portion for a printing area. The process used for distributing data to print heads will be described by employing FIGS. 9A to 9L.

When the resolution for an image to be printed is increased, it is preferable that the width of the edge portion (hereafter called the number of edge pixels) also be increased. The number of edge pixels depends on the amount of ink ejected by a print head, which is approximately determined in accordance with a resolution. For example, when print heads that eject ink at a resolution of 600×600 dpi are employed for image forming, a printing apparatus tends to be designed for which about 15 to 30 pl is selected as the amount of ink to be ejected by the print head (e.g., an ink ejection volume). In this case, the dot diameter for plain paper is usually about 60 μm.

Furthermore, when print heads that eject ink at a resolution of 1200×1200 dpi are employed for image forming, a printing apparatus tends to be designed for which about 4 to 15 pl is selected as the amount of ink to be ejected by the print heads (e.g., ink ejection volume). In this case, the dot diameter of ink ejected onto a print medium is usually about 30 μm for a case wherein plain paper is used.

It is not desirable that ink run off from the non-edge area across the edge area and outside a printed image. Therefore, it is preferable that the edge area formed of low-permeation ink have a certain width. When the non-edge area is enclosed by the edge area having a certain width, high-permeation ink ejected onto the non-edge area can be prevented from running off outside across the edge area. The width of the edge area should be maintained so that bleeding due to high-permeation ink does not go beyond the edge area even when the resolution is increased. In the above described cases of printing at the resolution 600×600 dpi and at the resolution 1200×1200 dpi, so long as an appropriate number of edge pixels is designated for the 600×600 dpi case, the edge number of pixels required for the 1200×1200 dpi case need only be approximately doubled. When the number of pixels for the edge area is selected in accordance with the resolution, an edge area (edge portion) having an appropriate width is formed, and the running of high-permeation ink from the non-edge area across the edge area and bleeding of the high-permeation ink can be prevented. Therefore, degrading of the image quality can be suppressed. As described above, it is preferable that the width of the edge portion (width of the edge area) is determined in accordance with a difference in permeation between high-permeation ink, ejected onto the non-edge area, and low-permeation ink, ejected onto the edge area, and that the number of pixels is determined in consonance with the resolution. Therefore, when a high resolution is set for ink ejection by the print head, it is preferable that the number of pixels that form the edge portion be increased in accordance with the resolution.

Fourth Embodiment

The printing processing performed by an ink jet printing apparatus according to a fourth embodiment of the present invention will now be described. As for portions that correspond to those in the first to the third embodiments, the same reference numerals used for the first to the third embodiments are also provided, so as to avoid providing a description for these portions, and only different portions will be described below.

To perform printing, the ink jet printing apparatus for the first to the third embodiments employs a total of three print heads, i.e., two print heads that eject low-permeation ink and one print head that ejects high-permeation ink. In this embodiment, however, to perform printing, an ink jet printing apparatus employs only two print heads, a print head that ejects low-permeation ink and a print head that ejects high-permeation ink. The throughput of the print heads in this embodiment is lower than that of the print heads in the first to the third embodiments slightly; however, since the number of print heads required is reduced, the manufacturing cost for the ink jet printing apparatus can also be reduced.

Print heads 301 to 305, included in the ink jet printing apparatus for this embodiment, will now be described. The print heads 301 to 305 are to eject five types of ink, black (low-permeation ink), black (high-permeation ink), cyan, magenta and yellow (Ke, Km, C, M and Y). Of the print heads 301 to 305, the print heads 301 and 302 are employed to eject black ink. Further, of these print heads 301 to 302 for ejecting black ink, the print head 301 is to eject low-permeation ink that is comparatively slowly permeates a print medium, and the print head 302 is to eject high-permeation ink that comparatively rapidly permeates a print medium.

For this explanation, a two-pass printing mode is employed wherein the print heads 301 and 302 are divided into two areas in a direction in which a print medium is to be conveyed, and ink is to be ejected onto the individual areas. The upper half of the print head 301 is a portion 301*a*, located upstream in the direction in which a print medium is to be conveyed, and the lower half is a portion 301*b*, located downstream in this direction. Similarly, the upper half of the print head 302 is a portion 302*a* located upstream in the conveying direction, and the lower half is a portion 302*b* located downstream.

A scanning start direction employed as a determination reference will be described first. When the ink jet printing apparatus for this embodiment performs two-pass and bidirectional printing, at each end of the scan of the print heads, a print medium is conveyed at a distance equivalent to half the width that the print heads can print. Since this operation is easier to understand when the assumption is that a print medium is fixed, FIG. 11 where the print medium is fixed is employed for the explanation.

For this embodiment, an ink jet printing apparatus in the multipass printing mode is employed, whereby in accordance with multiple scans for a same printing targeted area, print heads pass by the same targeted printing area multiple times, and eject ink at each movement, so that an image is printed by a plurality of scans. According to two-pass printing in this embodiment, to form an image, two scans are performed by the print heads to the same targeted printing area.

Furthermore, in this embodiment, a plurality of ejection ports formed in the print heads are allocated to a plurality of areas. When the first scan is performed, half the ejection ports that are divided in the direction in which a print medium is to be conveyed are passed over the targeted printing area, and when the second scan is performed, the other half of ejection ports are passed over the printing targeted area. As a result, in this embodiment, an image on the targeted printing area is completed in two scans. For image printing for the non-edge area of the printing targeted area, the printing is performed by ink ejected from a part of the ejection ports allocated, among those of the print head that eject low-permeation ink, previously (third printing sequence). Sequentially, the printing is performed by ink ejected from a part of the ejection ports allocated, among those of the print head that eject high-permeation ink (fourth printing sequence).

Printing for area (1) is performed by scanning the print heads in the direction X, then, a print medium is conveyed, and printing for areas (1) and (2) is performed by scanning the print heads in the direction −X. Sequentially, the print medium is conveyed again, and printing for (2) and (3) is performed by scanning the print heads in the direction X. The scanning by the print heads and the conveying of the print medium are repeated, and the printing on the print medium is performed based on image data.

When the area (1) is focused on, printing by moving the print head in the direction X is performed and sequentially printing by scanning in the direction −X is performed. When the area (2) is focused on, printing by moving the print head in the direction −X is performed, and sequential printing by scanning in the direction X is performed. That is, the direction in which the print heads scan when first printing is to be performed for the print medium differs, depending on the areas of the print medium. In this specification, for a case like the ones for areas (1) and (3), wherein the print heads scan in the direction X when the first printing is to be performed, this is expressed by "the scan start direction is the direction X". Likewise, for a case like the ones for areas (2) and (4), wherein the print heads scan in the direction −X when the first printing is to be performed, this is expressed by "the scan start direction is the direction −X".

Figure 10A:
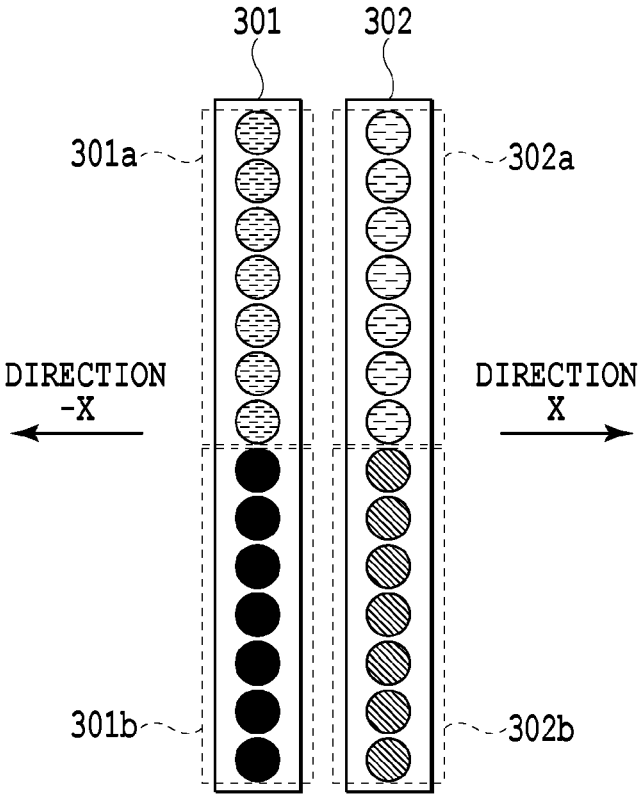
FIG. 10A is a schematic plan view of print heads employed for an ink jet printing apparatus according to a fourth embodiment of the present invention.
Figure 10B:
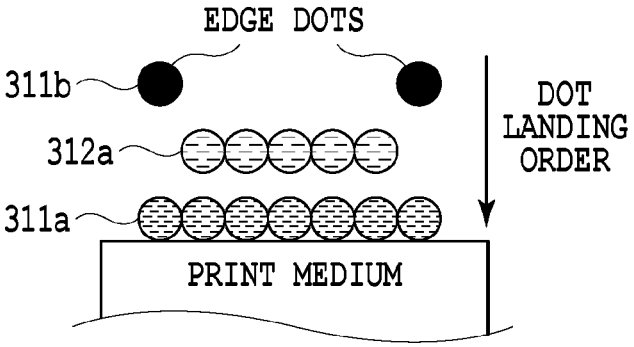
FIGS. 10B and 10C are explanatory diagrams for explaining the order in which ink is ejected by the print heads in FIG. 10A.
Figure 10C:
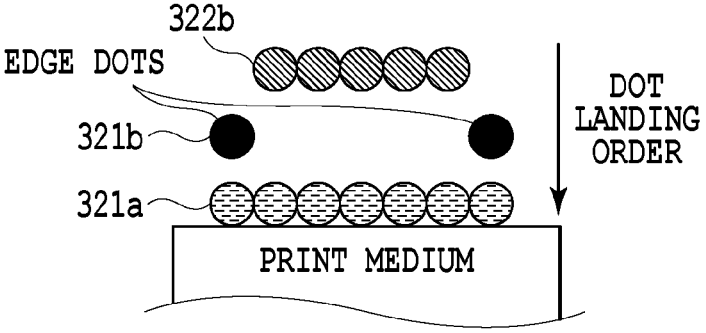

The order in which ink is applied to a print medium will now be described while referring to FIGS. 10A to 10C. Of the print heads 301 to 305, the print heads 301 and 302 that eject black ink are shown in FIG. 10A. The print head 301 is for ejecting low-permeation ink and the print head 302 is for ejecting high-permeation ink. The states showing the order in which ink droplets are ejected from the individual print heads are shown in FIGS. 10B and 10C. The state in FIG. 10B shows the order in which ink droplets land on the printing area after printing has been started by scanning in the direction −X. Further, the state in FIG. 10C is the order in which ink droplets land on the printing area after printing has been started by scanning in the direction X.

The printing processing performed for the area of a print medium for which the scan start direction is the direction −X will now be described, while referring to FIG. 10B. At the first scanning, the print head 301*a* ejects low-permeation ink 311*a* onto the non-edge area and the edge area, and the print head 302*a* ejects high-permeation ink 312*a* onto the non-edge area. When the first scanning has been completed, the print medium is conveyed a predetermined distance, and thereafter, the scan direction is reversed and the print heads 301 to 305 scan in the direction X, while at the same time performing the ejection of ink. At this time in the scanning in the direction X, the print head 301*b* ejects low-permeation ink 311*b* onto the edge area.

The printing processing performed for the area of a print medium for which the scan start direction is the direction X will now be described, while referring to FIG. 10C. At the first scanning, the print head 301*a* ejects low-permeation ink 321*a* onto the non-edge area and the edge area. When the first scanning has been completed, the print medium is conveyed a predetermined distance, the scan direction is reversed, and the print heads scan in the direction −X, while at the same time performing the ejection of ink. At this scanning in the direction X, the print head 301*b* ejects low-permeation ink 321*b* onto the edge area, and the print head 302*b* ejects high-permeation ink 322*b* onto the non-edge area. In this embodiment, the print head 301*b* that ejects low-permeation ink ejects ink only onto the edge area, and the print heads 302*a* and 302*b* that eject high-permeation ink eject ink only onto the non-edge area.

Figures 12, 12A:
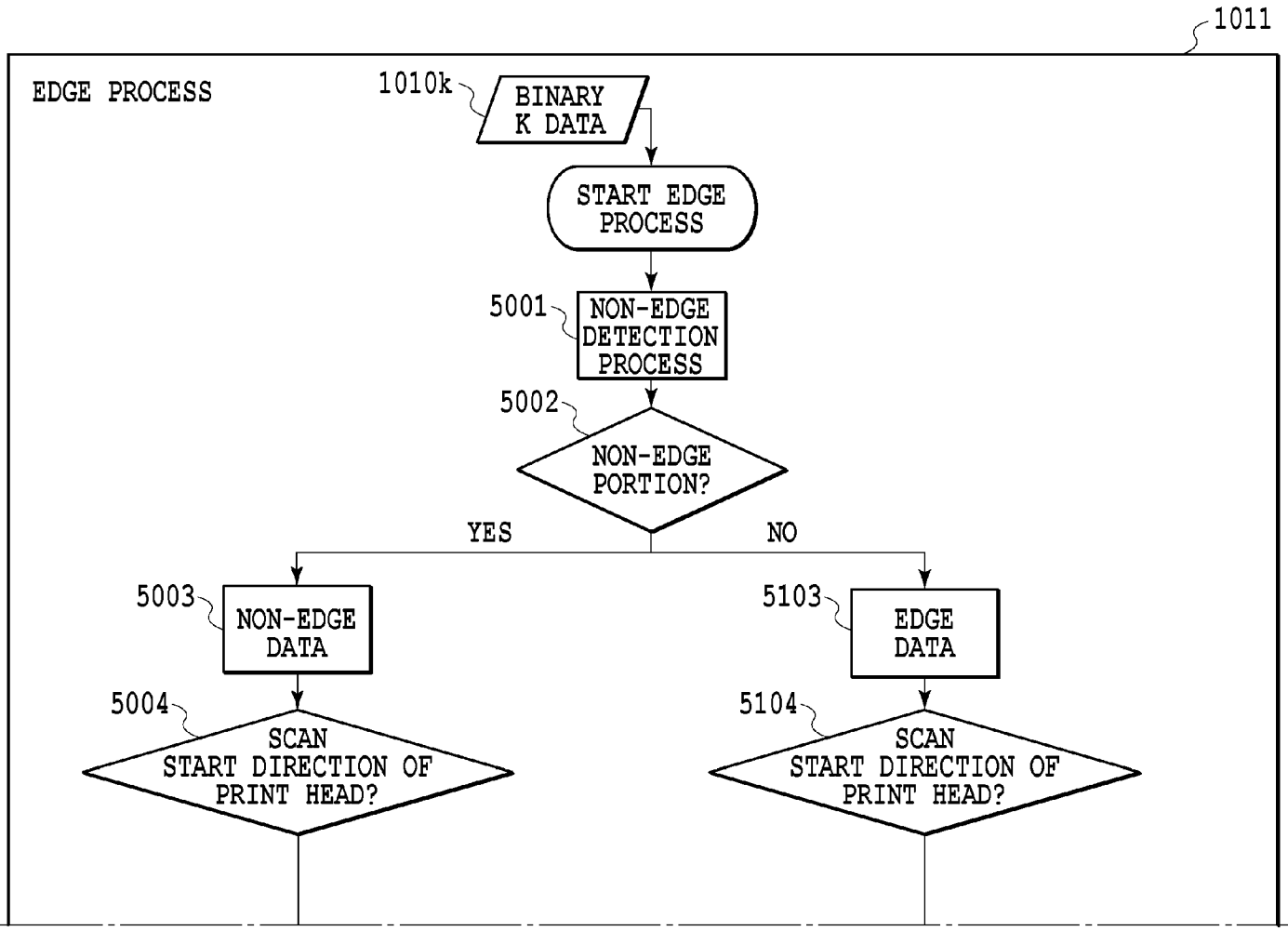
FIG. 12 is a diagram showing the relationship between FIGS. 12A and 12B.
FIGS. 12A and 12B are block diagrams illustrating a schematic arrangement for the transmission of data to explain the edge processing performed during the printing operation of the ink jet printing apparatus according to the fourth embodiment.
Figure 12B:
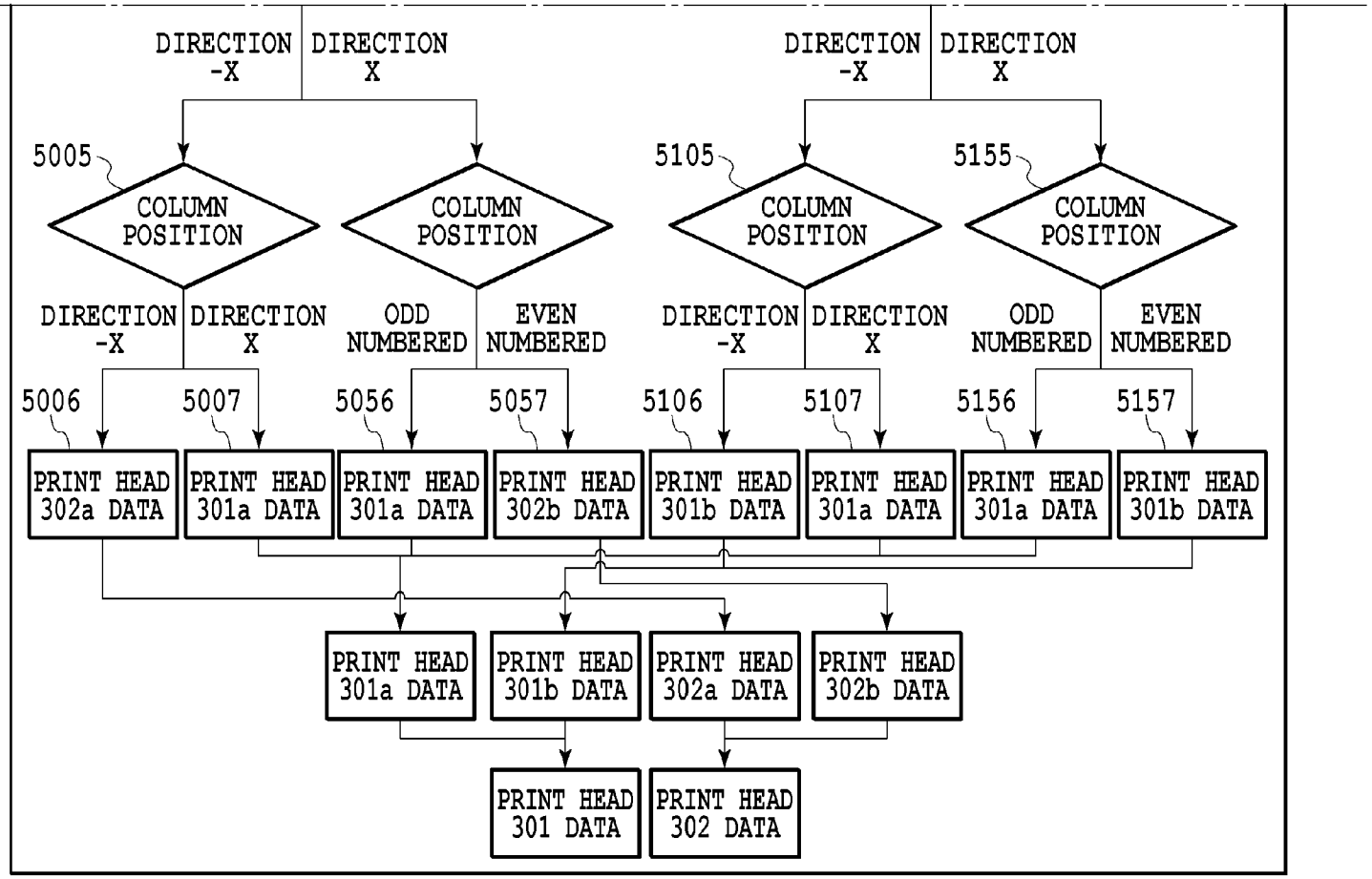

Next, the edge processing performed for binary black data will be described. FIGS. 12A and 12B are diagrams showing the steps of the edge processing. First, a non-edge detection process 5001 is performed. Thus, a data of a non-edge portion of a binary black data, i.e., non-edge area data 5003, is generated. The other portion of the binary black data, i.e., data that is not pertinent to the non-edge area data 5003, is edge area data 5103. In this embodiment, two pixels are selected as edge pixels. Further, in this embodiment, data are distributed for the individual print heads in accordance with the scan start directions of the print heads.

When the edge area data 5103 are to be printed in an area for which the scan start direction of the print heads is the direction X, data corresponding to the odd-numbered columns are printed by the print head 301*a*, and data corresponding to the even-numbered columns are printed by the print head 301*b*. When the edge area data 5103 are to be printed in an area for which the scan start direction of the print heads is the direction −X, data corresponding to the odd-numbered columns are printed by the print head 301*b*, and data corresponding to even-numbered columns are printed by the print head 301*a*.

When the non-edge area data 5003 are to be printed in an area for which the scan start direction of the print heads is the direction X, data corresponding to the odd-numbered columns are printed by the print head 301*a*, and data corresponding to the even-numbered columns are printed by the print head 302*b*. When the non-edge area data 5003 are to be printed in an area for which the scan start direction of the print heads is the direction −X, data corresponding to the odd-numbered data are printed by the print head 302*a*, and data corresponding to the even-numbered columns are printed by the print head 301*a*.

This relationship will now be described while referring to FIGS. 13A to 13O. As well as in the previously described embodiments, printed images shown in FIGS. 13C, 13H and 13L correspond to data allocated to the print head 301*a*. Similarly, images in FIGS. 13D, 13I and 13M correspond to data allocated to the print head 302*a*, FIGS. 13E, 13J and 13N correspond to data allocated to the print head 301*b*, and images in FIGS. 13F, 13K and 13O correspond to data allocated to the print head 302*b*.

Figures 13A, 13B, 13C, 13D, 13E, 13F, 13G, 13H, 13I, 13J, 13K, 13L, 13M, 13N, 13O:
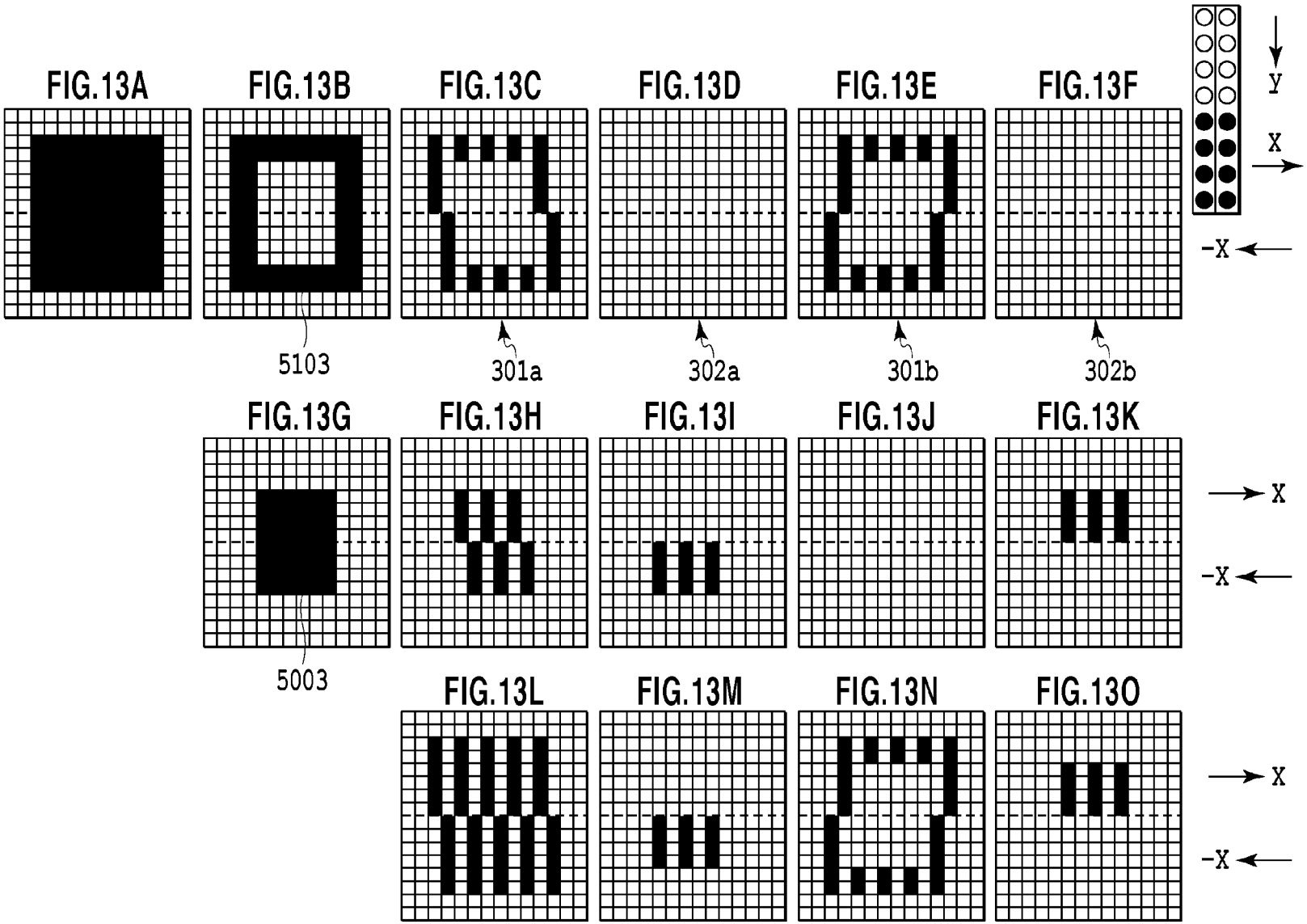
FIGS. 13A to 13O are explanatory diagrams for explaining a data distribution process for allocating, for the individual print areas, data that are to be printed in the fourth embodiment.

FIG. 13A is a diagram showing pixels that are ejected onto a print medium based on binary black data. A broken line extended horizontally in the center in FIGS. 13A to 13O indicates the position at which the scan start direction of the print heads changes.

Figure 11:
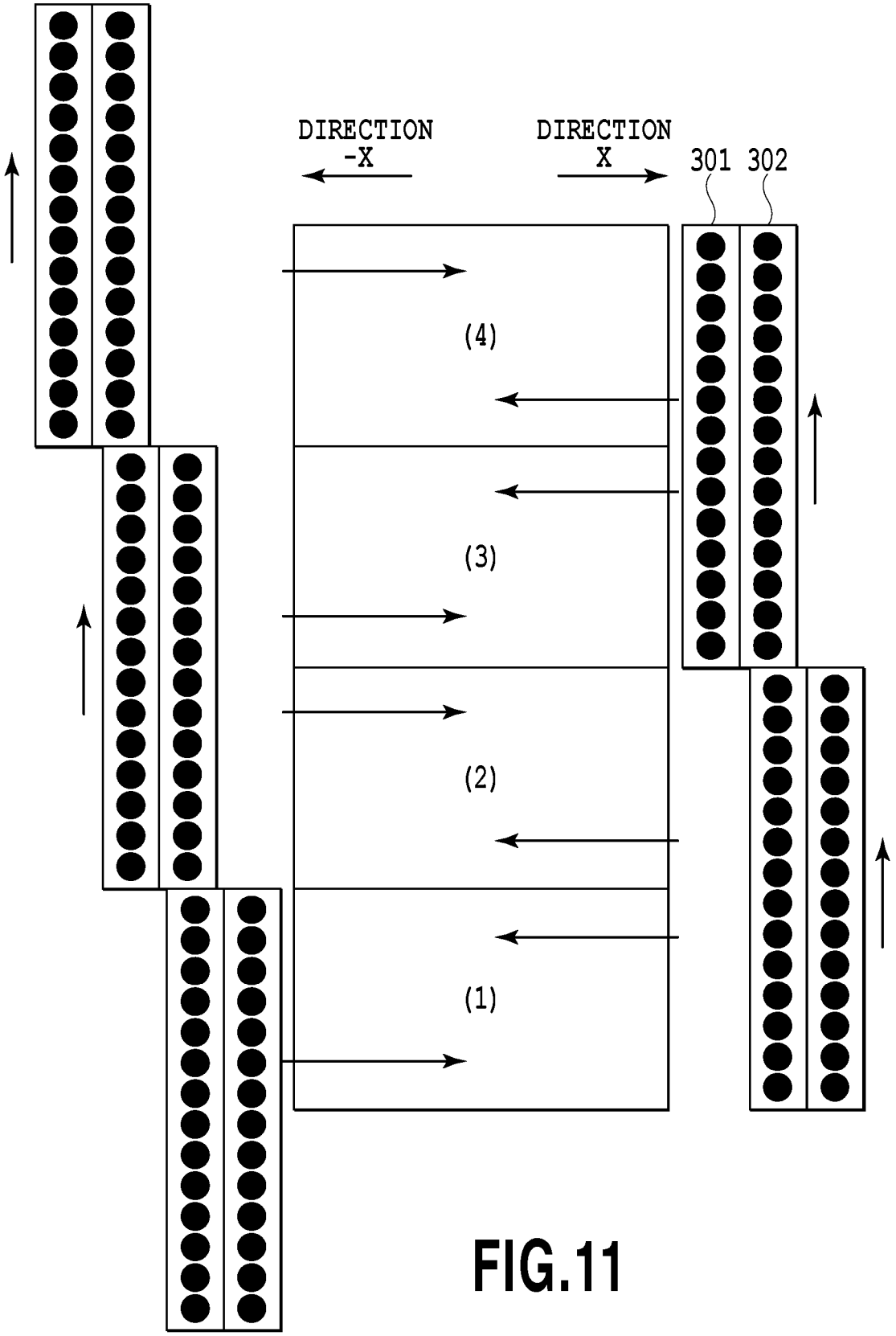
FIG. 11 is an explanatory diagram illustrating a relationship between the positions of the print heads and the position of the targeted print area of a print medium when printing is to be performed using the print heads in FIGS. 10A to 10C.

The portion above the broken line is an area, such as the area (1) or (3) in FIG. 11, where the scan start direction of the print heads is the direction X (right in FIGS. 13A to 13O), and the portion below the broken line is an area, such as the area (2) or (4) in FIG. 11, where the scan start direction of the print heads is the direction −X (left in FIGS. 13A to 13O). The non-edge detection process 5001 is performed for print data, and the non-edge area data 5003 and the edge area data 5103 are generated.

Of the binary black data in FIG. 13A, the edge area data 5103 are shown in FIG. 13B. Of the edge area data 5103, the odd-numbered columns in an area above the broken line, for which the scan start direction of the print heads is the direction X, is assigned to the print head 301*a*, and is printed (FIG. 13C). Further, of the other edge area data 5103, the even-numbered columns in the area for which the scan start direction of the print heads is the direction X, is assigned to the print head 301*b* and is printed (FIG. 13E). Of the edge area data 5103, odd-numbered columns in an area below the broken line, for which the scan start direction of the print heads is the direction −X, is allocated to the print head 301*b* and is printed (FIG. 13E). Further, of the other edge area data 5103, the even-numbered columns in the area for which the scan start direction of the print heads is the direction −X, is allocated to the print head 301*a* and is printed (FIG. 13C).

The non-edge area data 5003 of binary black data in FIG. 13A is shown in FIG. 13G. Among the non-edge area data 5003 in FIG. 13G, the portion that corresponds to the odd-numbered columns in an area above the broken line, for which the scan start direction of the print heads is the direction X, is allocated to the print head 301*a*. Printing is performed according to the print data allocated to the print head 301*a* (FIG. 13H). Of the non-edge area data 5003, the even-numbered columns in the area, for which the scan start direction of the print heads is the direction X, is allocated to the print head 302*b*, and printing is performed by the print head 302*b* based on the data (FIG. 13K).

Further, of the portion of the non-edge area data 5003, the odd-numbered columns in an area below the broken line, for which the scan start direction of the print heads is the direction −X, is allocated to the print head 302*a*, and printing is performed by the print head 302*a* based on the data (FIG. 13I). Of the non-edge area data 5003, the even-numbered columns in the area, for which the scan start direction of the print heads is the direction −X, is allocated to the print head 301*a* and printing is performed by the print head 301*a* based on the data (FIG. 13H).

As a result, the following print data are employed by the individual print heads. An image printed by the print head 301*a* is the logical sum (FIG. 13L) of the edge area data in FIG. 13C and the non-edge area data in FIG. 13H. An image printed by the print head 302*a* is the logical sum (FIG. 13M) of the edge area data in FIG. 13D and the non-edge area data in FIG. 13I. An image printed by the print head 301*b* is the logical sum (FIG. 13N) of the edge area data in FIG. 13E and the non-edge area data in FIG. 13J. An image printed by the print head 302*b* is the logical sum (FIG. 13O) of the edge area data in FIG. 13F and the non-edge area data in FIG. 13K.

As shown in FIGS. 13A to 13O, data to be printed by the individual print heads 301 and 302 are thinned out in the main scan direction (the direction X in FIG. 1 or a horizontal direction in FIGS. 13A to 13O), and half a volume of print data are printed at one scanning. Therefore, compared with when printing is performed for all the print data at one scanning, a period required for data transfer to the print head and the ink refilling period can be reduced by half. Therefore, the main scanning speed of the print head can be increased to twice that for a mode wherein print data is not thinned. In a case wherein, for example, the scanning resolution of the print head is 1200 dpi and the main scanning speed is 25 ips, the number of dots to be formed can be reduced to 600 dpi by thinning out data that are to be printed at one scanning. As a result, the main scanning speed of the print head can be raised to 50 ips. Therefore, the overall printing time can be reduced, and the throughput for printing can be improved.

Figure 14A:
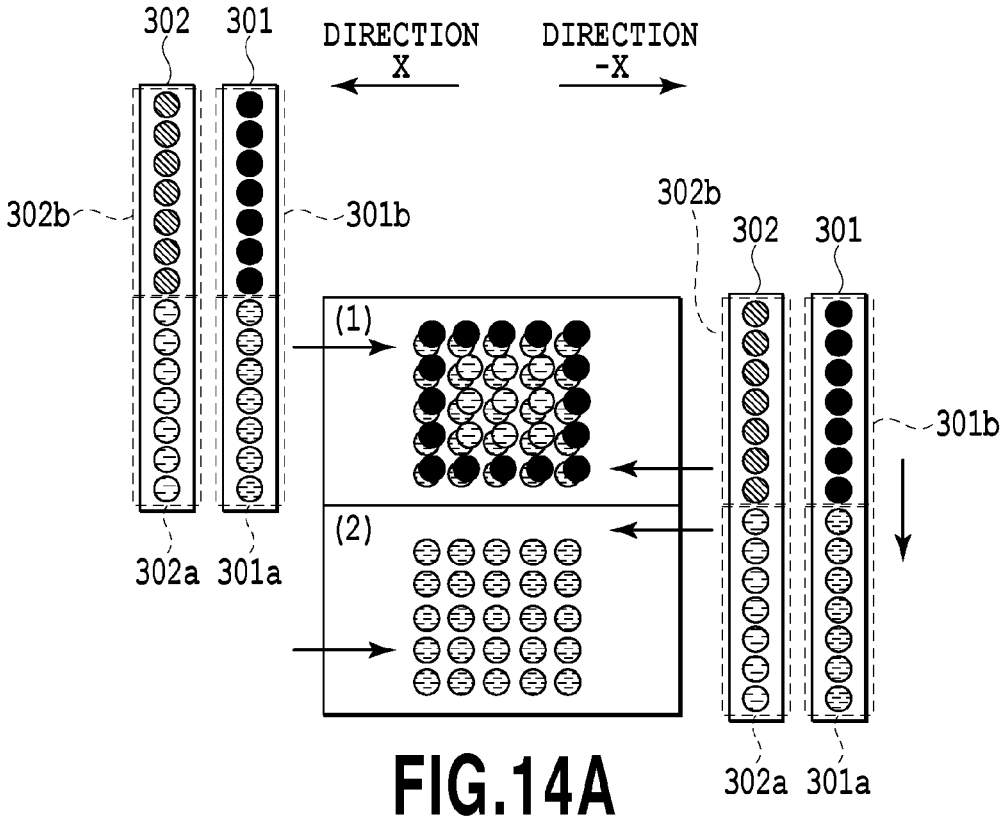
FIGS. 14A and 14B are explanatory diagrams for explaining the order in which ink is ejected by print heads that are employed for printing in the fourth embodiment.
Figure 14B:
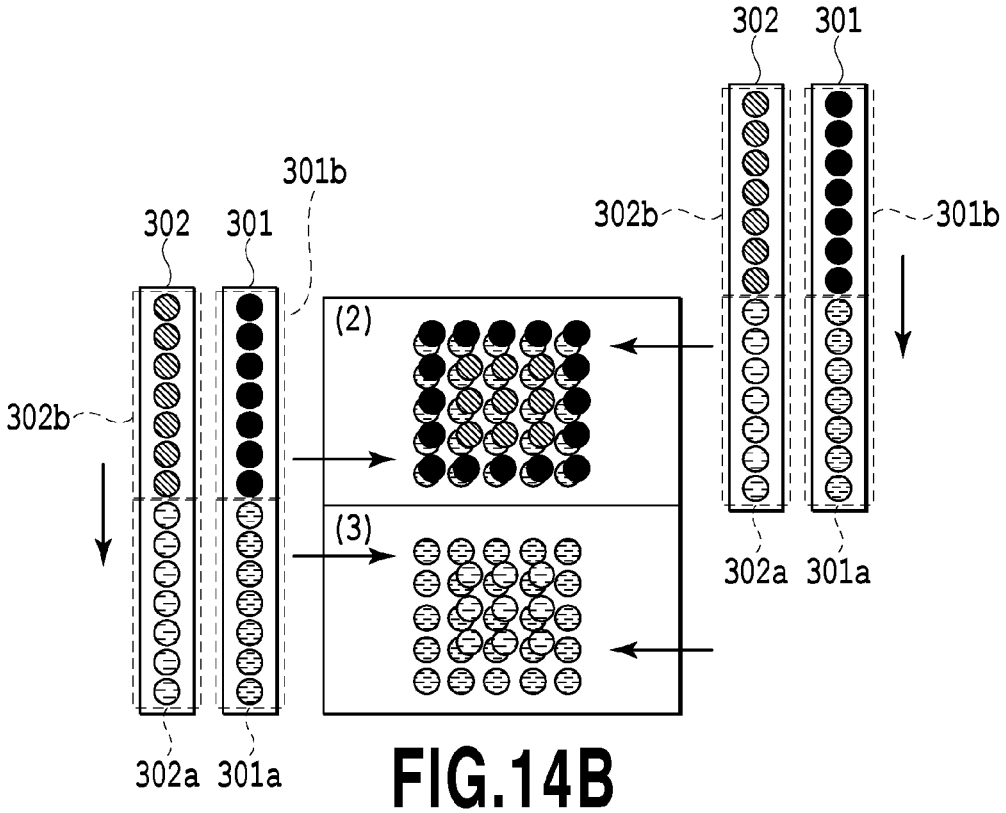

The edge processing performed for black data will be described in more detail while referring to FIGS. 14A and 14B. In FIGS. 14A and 14B, the scan start direction is the direction X for areas (1) and (3) or the direction −X for the area (2). In this embodiment, for printing the edge area (edge portion), ink is ejected by the print head 301*a* and sequentially ink is ejected by the print head 301*b*, regardless of the scan start direction X or −X. Since both print heads 301*a* and 301*b* are employed for ejection of the ink, a reduction in the number of dots to be printed at one scanning can be complemented by ejecting ink from the two print heads each other. For printing the non-edge area, all of the segments of the print head 301*a* eject low-permeation ink. In this printing process, half of the data are thinned out, and the other print heads perform the ejection of ink in order to complement the portion that was not printed when ink was ejected by the print head 301*a*.

As shown in the area (1) in FIG. 14A, when the scan start direction is the direction −X, not only the print head 301*a* ejects ink, but also the print head 302*a* ejects ink at the same time of scanning. At this time, since the print head 302*a* is located rear of the print head 301*a* in the scan direction, at first the print head 301*a* ejects low-permeation ink, and then the print head 302*a* ejects high-permeation ink. In other words, ejection of ink to a print medium is performed in the order of low-permeation ink and high-permeation ink.

Further, as shown in FIGS. 14A and 14B, when the scan start direction is the direction X, at the first scanning time, the print head 302*a* does not perform ink ejection, and only the print head 301*a* ejects ink. The print head 302*a* is not employed for printing when the direction X is the scan start direction, because before the print head 301*a* ejects low-permeation ink, the print head 302*a* that ejects high-permeation ink has passed by the printing targeted area. In such a case, printing by ink ejection can not be performed in order of low-permeation ink and high-permeation ink, which are the elements of the present invention.

When printing has been performed by ink ejection from the print head 301*a* and one scanning is completed, the scan direction is reversed, and the print heads are begun to scan in the direction −X. At this time, as shown in the area (2) in FIG. 14B, the print head 302*b* ejects high-permeation ink to the non-edge area to perform printing.

As described above, regardless of the scan start direction of X or −X, high-permeation ink is ejected by the print head 302*a* or 302*b* after low-permeation ink that has been already landed. In this embodiment, dots of low-permeation ink ejected first and dots of high-permeation ink ejected second are overlapped or adjacent to each other on a print medium based on the print data, and the print data is at least in contact with each other.

Since low-permeation ink has a relatively low permeation rate, the ink remains on the surface of the print medium until high-permeation ink ejected by the print heads 302*a* and 302*b* is landed on the surface of the print medium. When the low-permeation ink and the high-permeation ink contact and are mixed, the permeation rates of the two inks are averaged. That is, the permeation rate of the ink is increased more than the portion that is printed only using low-permeation ink. When printing is performed for one part of the non-edge area (non-edge portion) of an image, by ejecting ink at a low permeation rate first and ink at a high permeation rate subsequently, the better rub resistance can be obtained, compared with when printing is performed using only low-permeation ink that has a low permeation rate.

Furthermore, low-permeation ink ejected by the print head 301*b* is ejected on the low-permeation ink that was previously ejected by the print head 301*a*. Since low-permeation ink has a low permeation rate, the ink remains on the surface of a print medium until the ink ejected from the rearmost print head has been landed on the surface of the print medium. When the low-permeation ink and the low-permeation ink blend together on the surface of the print medium, the permeation rate is not increased, and all that has happened is that now there are two layers of ink that has a low permeation rate. Since ink having a low permeation rate is employed to print the edge area (edge portion) of an image, the sharpness of the edge of an image can be increased, and the print quality of characters and lines can be improved. Further, since the ejection of low-permeation ink first and high-permeation ink subsequently, is performed for the non-edge area, the optical density for the non-edge area can be increased, compared with when only high-permeation ink is employed for printing.

As described above, according to this embodiment, the print head that ejects low-permeation ink and the print head that ejects high-permeation ink are divided into a plurality of segments. Accordingly, a plurality of ejection ports formed in each print head are separated into these segments. For printing the non-edge area, at first, one part of the print head that ejects low-permeation ink passes by the printing targeted area, and then, one part of the print head that ejects high-permeation ink passes by that area. While passing the targeted printing area, the individual print heads eject ink onto the targeted printing area, so that printing is performed.

Generally, it is assumed that four print heads are necessary when the print heads scan and eject ink, onto a targeted printing area, in the order low-permeation ink and the high-permeation ink, regardless of the scan direction. However, in the fourth embodiment, a multipass printing apparatus, whereby an image is formed by multiple scans, is employed, and a plurality of ejection ports formed in the individual print heads are divided into a plurality of segments. Further, regardless of the scan direction of the print heads, a targeted printing area is printed by ejecting ink from one part of the print head that ejects low-permeation ink, and then ejecting ink from one part of the print head that ejects high-permeation ink.

As described above, in this embodiment, two print heads, i.e., a print head that ejects low-permeation ink and a print head that ejects high-permeation ink, are employed for performing printing. Throughput for the print heads for this embodiment is slightly lower than is that for the print heads of the first to the third embodiments; however, the number of print heads required can be reduced. Thus, the cost of manufacturing the printing apparatus can be reduced.

In this embodiment, for the print head that ejects low-permeation ink and the print head that ejects high-permeation ink, a plurality of ejection ports are divided into two segments; however, the present invention is not limited to such an arrangement. The print head that ejects low-permeation ink and the print head that ejects high-permeation ink may be divided into two or more segments. So long as the order of ejection of low-permeation ink first, and the ejection of high-permeation ink subsequently, is designated, the individual print heads may be divided into more than two segments. In addition, two-pass printing has been employed for this embodiment; but the present invention is not limited to this example, and three-pass printing or four-pass printing may also be employed. Further, in this case, simply the print heads need to be controlled so they eject low-permeation ink first, during the first scanning for the targeted printing area, and then eject high-permeation ink.

Fifth Embodiment

The printing processing performed by an ink jet printing apparatus according to a fifth embodiment of the present invention will now be described. As for portions that correspond to those in the first to the fourth embodiments, the same reference numerals used for the first to the fourth embodiments are also provided, so as to avoid the need to provide another description for these portions, and only different portions will be described below.

In the first to the fourth embodiments, an example wherein only black ink is ejected by the print heads has been described. In the fifth embodiment, an example is provided wherein the parallel printing of black and color inks is performed.

When an area to be printed using color ink, and an area to be printed using black ink lie adjacent to each other, for printing processing, it is better that the adjacent boundary portions of these areas are not as edge portions, but as non-edge portions, frequently. An printing data generation method employed when the parallel printing of black and color inks is to be performed is shown in FIGS. 15A to 15L.

Figures 15A, 15B, 15C, 15D, 15E, 15F, 15G, 15H, 15I, 15J, 15K, 15L:
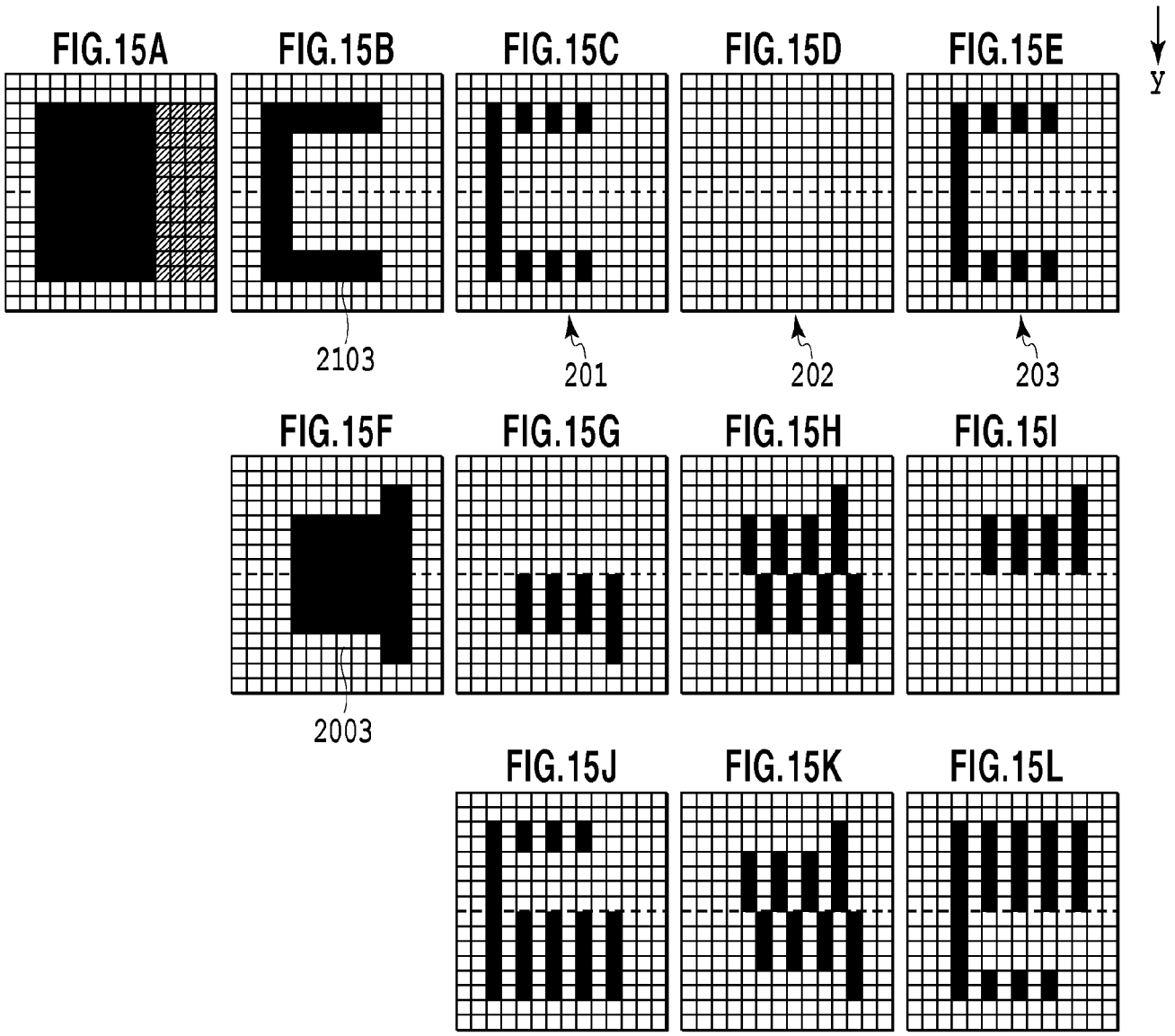
FIGS. 15A to 15L are explanatory diagrams for explaining a data distribution process for allocating, for the individual print areas, data that are to be printed according to a fifth embodiment of the present invention.

A hatched portion in FIG. 15A is for color image data, and a solid black portion indicates, as in FIG. 8A, binary image data for printing performed using black ink. Edge area data 2103 is shown in FIG. 15B, and non-edge area data 2003 is shown in FIG. 15F. When the data in FIG. 15B is compared with the data for the second embodiment in FIG. 8B, print data is generated by regarding as a non-edge portions, the right side area that is adjacent to the area to be printed using color ink, and that was regarded as part of the edge portion when printing was performed using only black ink.

Furthermore, when a permeation of the low-permeation color ink and a permeation of the low-permeation black ink are compared, in case that the permeation of low-permeation color ink into a print medium is higher than the permeation of low-permeation black ink, it is preferable that the permeation of black ink be relatively increased. And when the permeation of color ink is faster than the permeation of black ink, there is a possibility that black ink that has not permeated the print medium may mix with color ink at a color ink printed portion, and may run into the color printed area. Therefore, when only low-permeation ink is employed to print a portion of an area to be printed using black ink, and the portion is adjacent to an area that is to be printed using color ink, the quality of the image obtained may be degraded. In order to avoid this, the considered opinion is that, when an area to be printed using black ink and an area to be printed using color ink are adjacent, the relative permeation of black ink be increased, in order to preserve the image quality.

Sixth Embodiment

The printing processing performed by an ink jet printing apparatus according to a sixth embodiment of the present invention will now be described. As for portions that correspond to those in the first to the fifth embodiments, the same reference numerals used for the first to the fifth embodiments are also provided to avoid the need to prepare descriptions for these portions, and only different portions will be described below.

In the second to the fifth embodiments, print data is allocated to a plurality of print heads, and the number of dots that should be formed by each print head during one scan in the scan direction (main scan direction) is set equivalent to half the data resolution. With this arrangement, the scanning speed of the print heads is increased, and the throughput for printing is improved. In addition to these effects, in this embodiment, the number of print heads for ejecting low-permeation ink is increased, so that the number of droplets that each print head should form in the main scan direction (the direction X) can be reduced. As a result, the scanning speed of the print heads can be increased, and the throughput for printing can be improved.

Figure 16A:
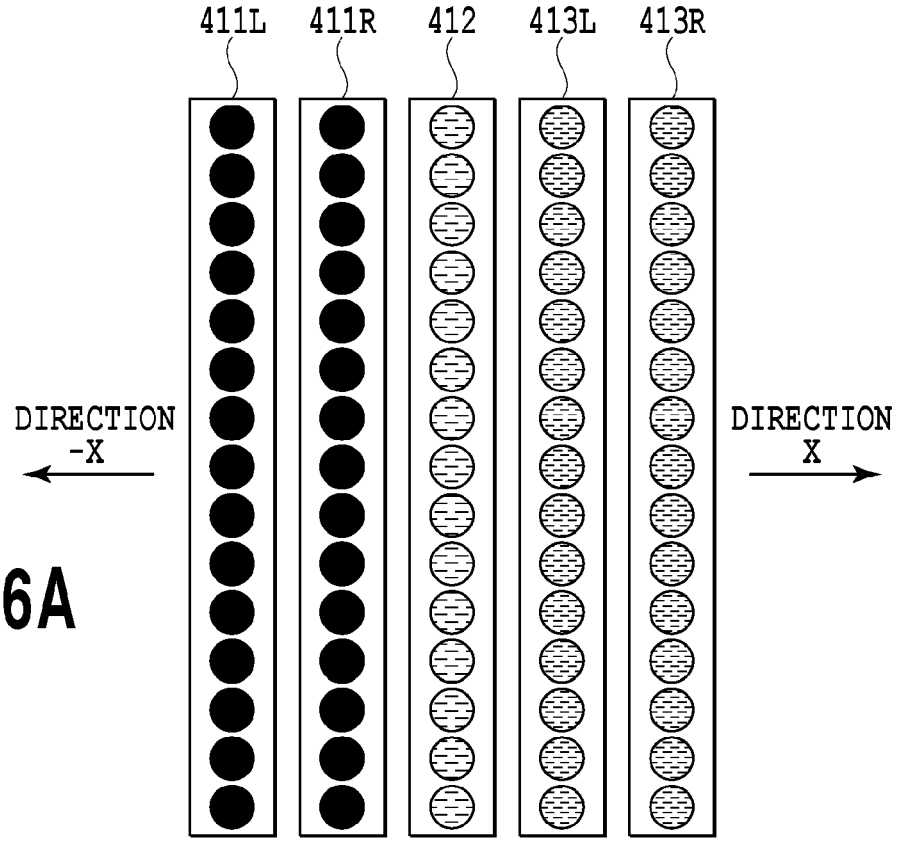
FIG. 16A is a schematic plan view of print heads employed for an ink jet printing apparatus according to a sixth embodiment of the present invention.
Figure 16B:
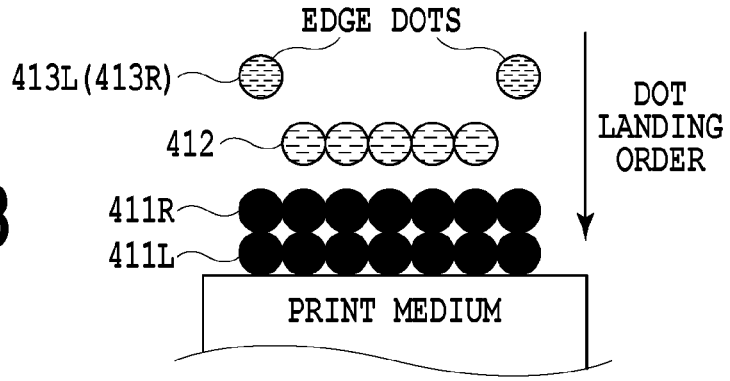
FIGS. 16B and 16C are explanatory diagrams for explaining the order in which ink is ejected by the print heads in FIG. 16A.
Figure 16C:
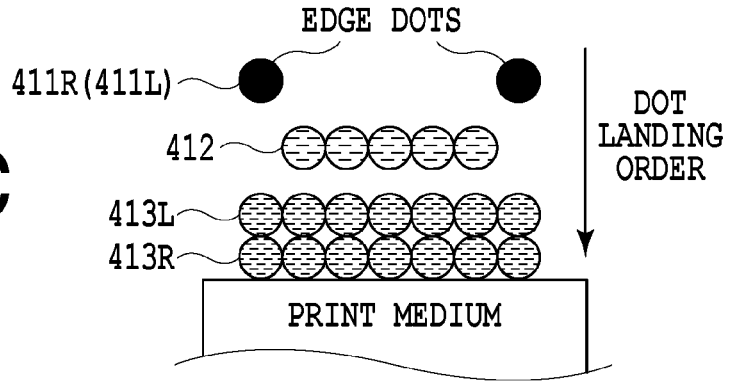

The structure of the print heads and the order in which ink is ejected will now be described while referring to FIGS. 16A to 16C. In this embodiment, a total of five print heads are employed. A print head 412 that ejects high-permeation ink is located in the center, and print heads 411L, 411R, 413L and 413R that eject low-permeation ink are positioned to either side of the print head 412. For this embodiment, the print heads 411L and 411R are arranged on the left side of the print head 412 in FIG. 16A, and the print heads 413L and 413R are arranged on the right side of the print head 412 in FIG. 16A.

When an ink jet printing apparatus for this embodiment performs printing, two of the print heads that eject low-permeation ink are first employed to eject ink onto the non-edge area (non-edge portion). When the scan direction of the print heads is the direction X, the print heads 413R and 413L are employed, or when the scan direction is the direction –X, the print heads 411L and 411R are employed. Sequentially, the print head 412 is employed to eject high-permeation ink. For printing the edge area, one of the print heads for ejecting low-permeation ink (411R or 411L for the direction X, or 413L or 413R for the direction –X) that is located backward in the scan direction is employed to eject ink.

Seventh Embodiment

The printing processing performed by an ink jet printing apparatus according to a seventh embodiment of the present invention will now be described.

In this embodiment, the color material density for low-permeation ink is lower than the color material density of high-permeation ink, and only low-permeation ink is to be ejected to the edge area of a printing targeted area. Therefore, it will frequently appear in places that ink is raised on the surface of a print medium, and when something, such as a finger, touches the color materials on the raised portions on the print medium, there is a probability that a printed image will be smudged and the image quality will be degraded. Further, when a printed image is traced using a marker pen, bleeding of the color materials may occur, and the image quality would be degraded.

Therefore, in this embodiment, the color material density of low-permeation ink to be ejected to the edge area is reduced in order to prevent the color material printed in the edge area from rising the surface of the print medium. As a result, the bleed fastness and the rub resistance for the outer portion of a printed image can be improved. The composition of ink employed for this embodiment is as follows. The ratio of the individual components are represented using parts by mass (the total of all the components is 100 parts by mass).

(Low-Permeation Ink 2)

| | |
|---|---|
| Pigment dispersion | 20 parts by mass |
| Glycerine | 10 parts by mass |
| Polyethylene glycol 1000 | 1 part by mass |
| Acetylenol E100 (trademark by Kawaken Fine Chemicals Co., Ltd.) | 0.03 parts by mass |
| Water | Remaining parts |

Eighth Embodiment

The printing processing performed by an ink jet printing apparatus according to an eighth embodiment of the present invention will now be described.

In this embodiment, a case wherein the ink composition represented in the seventh embodiment is employed to perform printing using black ink and printing using color ink in parallel to each other will now be described. As described for the fifth embodiment, when an area to be printed in black ink and an area to be printed in color ink are adjacent to each other, it is appropriate for many cases that the boundary portion of these areas be regarded as a non-edge portion, instead of an edge portion. Therefore, also in this embodiment, the boundary portion where an area to be printed in black ink and an area to be printed in color ink contact each other is regarded as a non-edge portion, instead of an edge portion, and not only low-permeation ink but also high-permeation ink are employed to print this boundary portion.

Ninth Embodiment

The processing performed by an ink jet printing apparatus according to a ninth embodiment of the present invention will now be described.

In this embodiment, as well as in the eighth embodiment, a case wherein the ink composition represented in the seventh embodiment is employed to perform printing using black ink and printing using color ink in parallel to each other will now be described. As described for the fifth and the eighth embodiments, when an area to be printed in black ink and an area to be printed in color ink are adjacent to each other, it is appropriate for many cases that the boundary portion of these areas contacting each other be regarded as a non-edge portion, instead of an edge portion.

However, the ink jet printing apparatus as in this embodiment that employs low-permeation ink having low color material density may not include a function for determining whether an area to be printed in black ink and an area to be printed in color ink are adjacent to each other. In the portion where the area to be printed in black ink and the area to be printed in color ink are adjacent to each other, when low-permeation ink is employed to print the edge portion of the area to be printed in black ink, the low-permeation ink sometimes runs from the black printed area to the color printed area. Therefore, the sharpness of the black image tends to be reduced. However, when low-permeation ink having low color material density is employed in this embodiment, the degrading of the image quality is not noticeable even if black ink runs into the color printed area. Therefore, the degrading of the color image caused when black ink runs into color ink can be suppressed.

Other Embodiments

In the above described embodiments, an example wherein slow-drying black ink and fast-drying black ink of similar colors are employed to perform printing has been described. The color material density may differ for inks of similar colors, but as described above, it is preferable that the color material density of low-permeation ink is lower than the color material density of high-permeation ink. Furthermore, the present invention is not limited to the above described embodiments, and low-permeation ink and high-permeation ink may be employed for the other colors to perform printing. At this time, low-permeation ink being ejected first, and then high-permeation ink being ejected subsequently, is required.

Further, bidirectional printing has been performed for the above described embodiments. However, the present invention is not limited to this type of printing, and unidirectional printing may be performed so long as lowering of a throughput from that of bidirectional printing is allowable. In this case, when a print head that ejects low-permeation ink is positioned in front of a print head that ejects high-permeation ink in the scan direction, low-permeation ink can be ejected to the non-edge area prior to high-permeation ink, and the same effects of the present invention can be obtained.

In the above embodiments, an example that the printing has been performed by scanning the print heads relative to the print medium is illustrated; however, the present invention is not limited to this operation, and any arrangement may be employed so long as printing is performed by relative movements between print heads and a print medium. That is, a print medium may be moved relative to the print heads. Furthermore, the present invention is not limited to the arrangement as in the above embodiments that prepares print heads for the individual colors, and may provide a single, or a plurality of print heads that have ejection port arrays to eject ink for the individual colors.

In the specification of this invention, "printing" represents forming of not only significant information, such as characters or graphics, but also insignificant information. Further, "printing" also represents forming of an image, a figure or a pattern on a print medium, regardless whether the object can be visually seen by for a human being, and also includes processing of a print medium.

The "ink jet printing apparatus" includes an apparatus, such as a printer, an all-in-one printer, a copy machine or a facsimile machine, that has a printing function, and an apparatus that produces goods using the ink jet printing technology.

The "print medium" represents not only a sheet employed for a common printing apparatus, but also includes a variety of materials, such as textile, plastic film, a metal plate, glass, ceramics, wood and leather, that accept ink.

Furthermore, the definition of "ink" (or sometimes called a "fluid") should be broadly applied as well as that of "printing". The ink is a fluid that is to be employed by being applied to a print medium for forming an image, a figure or a pattern, for processing a print medium, or for processing ink (e.g., coagulating or insolubilizing of the color materials in ink that is applied to a print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-163890, filed Jul. 21, 2010, which is hereby incorporated by reference herein in its entirety.

What is claimed is:

1. An ink jet printing apparatus comprising:

a print head configured to eject a first ink and a second ink for printing an image on a printing medium, wherein the second ink is a similar color to a color of the first ink and has higher permeation into the print medium than the first ink; and a printing controller configured to control ejection of the first ink and the second ink from the print head, in both a scan in which the print head scans in a first direction and a scan in which the print head scans in a second direction that is opposite to the first direction, wherein the printing controller is further configured to control ink ejection for a predetermined area such that both the first ink and the second ink are ejected to the predetermined area, and the first ink is ejected prior to the second ink in both the scan in the first direction and the scan in the second direction.

2. The ink jet printing apparatus according to claim 1, wherein the print head includes a first ejection port array configured to eject the first ink, a second ejection port array configured to eject the second ink and a third ejection port array configured to eject the first ink, and wherein, in the print head, the second ejection port array is arranged between the first ejection port array and the third ejection port array.

3. The ink jet printing apparatus according to claim 2, wherein the printing controller is further configured to control ink ejection from the print head for the predetermined area such that:

(i) the first ejection port array and the second ejection port array are employed during the scan in the first direction, where the first ejection port array is positioned forward of the second ejection port array and the third ejection port array, and (ii) the second ejection port array and the third ejection port array are employed during the scan in the second direction where the third ejection port array is forward of the second ejection port array and the first ejection port array.

4. The ink jet printing apparatus according to claim 3, wherein the printing controller is further configured to control ink ejection from the print head for the predetermined area such that the third ejection port array is not employed during the scan in the first direction, and the first ejection port array is not employed during the scan in the second direction.

5. The ink jet printing apparatus according to claim 1, wherein the printing controller is further configured to control ink ejection from the print head for the predetermined area such that the first ink and the second ink are ejected at the same position and overlap each other.

6. The ink jet printing apparatus according to claim 1, wherein the printing controller is further configured to control ink ejection from the print head for the predetermined area such that the first ink and the second ink are ejected at different but adjacent positions.

7. The ink jet printing apparatus according to claim 1, wherein the color of the first ink and the color of the second ink are black.

8. The ink jet printing apparatus according to claim 1, wherein the first ink and the second ink include pigment materials.

9. The ink jet printing apparatus according to claim 1, wherein color material density for the first ink is lower than color material density for the second ink.

10. The ink jet printing apparatus according to claim 1, wherein, to perform printing, the print head performs a plurality of scans for the predetermined area.

11. The ink jet printing apparatus according to claim 1, wherein the image includes edge area and non-edge area that is located inside the edge area, the predetermined area is the non-edge area.

12. The ink jet printing apparatus according to claim 11, wherein the print controller is further configured to control ink ejection such that the first ink is ejected and the second ink is not ejected in the edge area.

13. The ink jet printing apparatus according to claim 1, wherein the first ink and the second ink are alternately ejected to pixels in the predetermined area.

14. An ink jet printing method for a print head configured to eject a first ink and a second ink, wherein the second ink is a similar color to a color of the first ink and has higher permeation into the print medium than the first ink, the ink jet printing method comprising:

a printing control step of controlling ejection of the first ink and the second ink from the print head while the print head scans in a first direction and a second direction that is opposite to the first direction, wherein ink ejection to a predetermined area is controlled such that both the first ink and the second ink are ejected to the predetermined area, and the first ink is ejected prior to the second ink in both the scan in the first direction and the scan in the second direction by the print head.

* * * * *